US008487826B2

(12) United States Patent
Cook

(10) Patent No.: US 8,487,826 B2
(45) Date of Patent: Jul. 16, 2013

(54) MULTI-BAND ANTENNA FOR SIMULTANEOUSLY COMMUNICATING LINEAR POLARITY AND CIRCULAR POLARITY SIGNALS

(76) Inventor: Scott Cook, Woodstock, GA (US)

( * ) Notice: Subject to any disclaimer, the term of this patent is extended or adjusted under 35 U.S.C. 154(b) by 628 days.

(21) Appl. No.: 12/697,957

(22) Filed: Feb. 1, 2010

(65) Prior Publication Data

US 2010/0194655 A1 Aug. 5, 2010

Related U.S. Application Data

(60) Provisional application No. 61/148,419, filed on Jan. 30, 2009.

(51) Int. Cl.
*H01Q 13/00* (2006.01)

(52) U.S. Cl.
USPC ..... 343/786; 343/772

(58) Field of Classification Search
USPC ..... 343/756, 786, 772, 776
See application file for complete search history.

(56) References Cited

U.S. PATENT DOCUMENTS

| | | | | |
|---|---|---|---|---|
| 4,797,681 | A | 1/1989 | Kaplan | |
| 5,258,768 | A | 11/1993 | Smith | |
| 6,323,819 | B1 | 11/2001 | Ergene | |
| 7,239,285 | B2 * | 7/2007 | Cook | 343/786 |
| 7,642,982 | B2 * | 1/2010 | Cook | 343/786 |
| 2007/0296641 | A1 | 12/2007 | Cook | |

FOREIGN PATENT DOCUMENTS

JP 57025705 A 2/1982

* cited by examiner

*Primary Examiner* — Hoanganh Le
(74) *Attorney, Agent, or Firm* — Michael J. Mehrman; Mehrman Law Office

(57) ABSTRACT

Multi-band antennas for simultaneously communicating linear polarity low-band signals and circular polarity high-band signals via a single antenna horn structure. The antennas horn structures have circular and oblong cross-sections. Strategic location and orientation of low-band and high-band ports with respect to internal ridges in transition sections and the major and minor axes of the oblong horn allows the antenna to simultaneously manipulate the high-band circular polarity signal without affecting the linear polarity low-band signals. The oblong horn shape and ridges may apply additive or oppositely sloped differential phase shifts to the linear components of the circular polarity high-band signal. For the horns with circular cross-section, the internal ridges may apply additive or oppositely sloped differential phase shifts to polarize the circular polarity high band signals without assistance from the internal shape of the horn.

19 Claims, 20 Drawing Sheets

MULTI-BAND ANTENNA FOR SIMULTANEOUSLY COMMUNICATING LINEAR POLARITY AND CIRCULAR POLARITY SIGNALS

REFERENCE TO RELATED APPLICATIONS

This application claims priority to commonly-owned copending U.S. Provisional Patent Application Ser. No. 61/148,419 entitled "Broad Band and/or Multi-Band Circular and/or Linear Polarity Feed Assembly" filed Jan. 30, 2009, which is incorporated herein by reference.

TECHNICAL FIELD

The present invention is generally related to multi-band antenna systems designed to simultaneously receive broadcast signals with circular and linear polarity and, more particularly, is directed to digital video broadcast satellite (DVBS) antenna systems.

BACKGROUND OF THE INVENTION

DVBS antenna systems for communicating with satellites are becoming increasingly complex. Quite often a given reflector antenna must be configured to simultaneously receive and transmit signals to multiple satellites. These satellites typically operate at different frequency bands and often with different polarities, making the feed assembly challenging to design and cost effectively produce and deploy in large quantities.

The antenna designs described in U.S. Pat. Nos. 7,239,285 and 7,642,982 address many of these challenges for oblong and circular antenna feed structures for receiving multi-band circular polarity signals. Although the antenna technology described in these patents is applicable to DVBS antennas generally, these patents have not disclosed multi-band antennas for simultaneously receiving combinations of linear polarity and circular polarity signals.

SUMMARY OF THE INVENTION

The present invention addresses the needs described above in a variety of multi-band antennas for simultaneously communicating combinations of linear polarity and circular polarity signals. The specific embodiments shown in the figures are designed to receive linear polarity low-band signals simultaneously with circular polarity high-band signals via a single antenna horn structure. Embodiments of the antennas horn structures have circular and oblong cross-sections. In general, strategic location and orientation of low-band and high-band ports with respect to internal ridges that form phase adjustment structures in transition sections and the major and minor axes of the oblong horn allows the antenna to simultaneously manipulate the high-band circular polarity signal without affecting the linear polarity low-band signals. For the horns with circular cross-section, the internal ridges polarize the circular polarity high band signals without assistance from the internal shape of the horn.

The oblong horn structures are phase adjustment structures configured to differentially phase shift the linear components of the circular polarity high-band signal without affecting the linear polarity low-band signals. For the horns with oblong cross-section, the internal oblong shape of the horn, alone or in combination with internal ridges, polarize the circular polarity high band signals. Over the full length of the antenna horn, the oblong horns and the ridges in combination serve to differentially phase shift and polarize the linear components of the circular polarity high-band signal by approximately 90 degrees to polarize the circular polarity high-band signal into linear components. Most of the embodiments include transition sections with ridges that form phase adjustment structures that operate in combination with the shape of the horn to polarize the circular polarity high-band signals without affecting the linear polarity low-band signals. In certain embodiments, the oblong horn and ridges impart oppositely sloped phase differential sections to improve the high-band gain and bandwidth performance of the antenna as described in U.S. Pat. Nos. 7,239,285 and 7,642,982.

Although the specific embodiments involve linear polarity low-band signals and circular polarity high-band signals, the principles of the invention are not limited to these configuration and could be applied, for example, to construct antennas that simultaneously communicate circular polarity low-band signals and linear polarity high-band signals. Similarly, the specific embodiments involve one low-band dual-polarity signal and one high-band circular polarity signal that is polarized into linear components, but could be applied to signals-polarity signals and a larger number of signals matters of design choice and the needs of specific applications.

DETAILED DESCRIPTION OF THE EMBODIMENTS

Figure 1A:
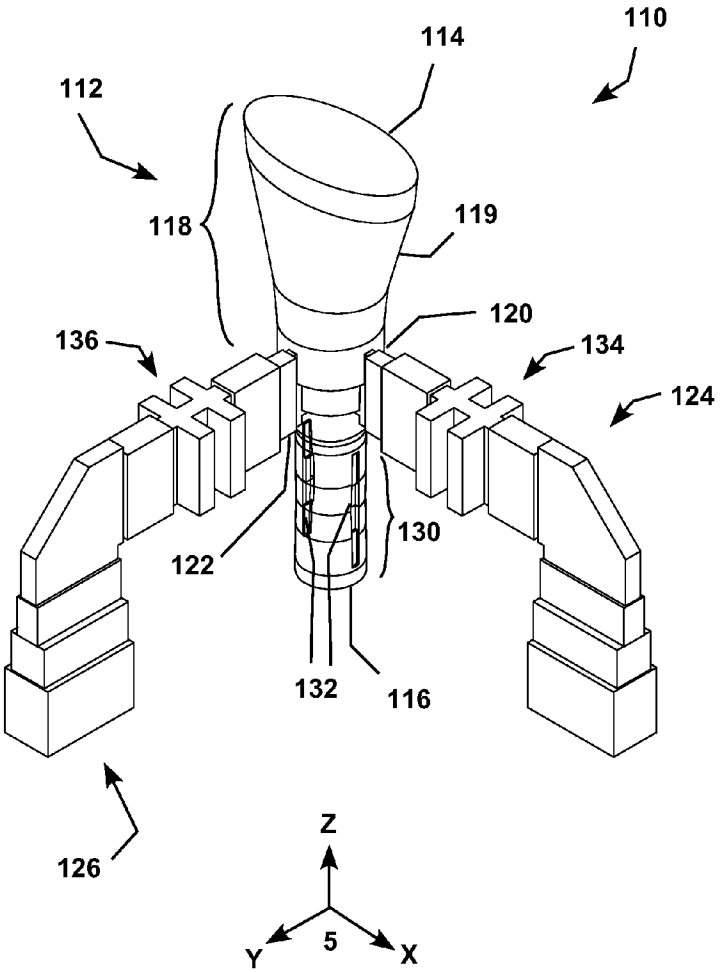
FIG. 1A is perspective view of a first multi-band antenna with an oblong horn designed to simultaneously communicate high high-band signals with circular and linear polarity and low-band signals with linear polarity.

The present invention may be embodied as improvements to the multi-band DVBS antennas described in U.S. Pat. Nos. 7,239,285 and 7,642,982, which are incorporated herein by reference. These patents teach the use of oppositely sloped phase differential transition sections including various combinations of internal ridges (including septums and corrugations, which are varieties of internal ridges) with oblong and circular horns to improve the bandwidth performance of the antennas. They also disclose multi-band antennas using these techniques for multiple circular polarity signals but do not disclose multi-band antennas for receiving combinations of linear polarity and circular polarity signals. Simultaneously communicating circular and linear polarity signals is challenging because the structures of the antennal must be designed to simultaneously polarize the circular polarity signals without adversely affecting the linear polarity signals. The embodiments of the present invention meet the challenge with cost effective, high performance antennas that transmit and receive multiple bands using multiple polarities.

The present invention develops multi-band antennas for simultaneously communicating linear polarity low-band signals and circular polarity high-band signals via a single antenna horn structure. Various antennas horn structures have circular and oblong cross-sections. Strategic location and orientation of low-band and high-band ports with respect to internal ridges in transition sections and the major and minor axes of the oblong horn allows the antenna to simultaneously manipulate the high-band circular polarity signal without affecting the linear polarity low-band signals. The oblong horn shape and ridges may apply additive or oppositely sloped differential phase shifts to the linear components of the circular polarity high-band signal. For the horns with circular cross-section, the internal ridges may apply additive or oppositely sloped differential phase shifts to polarize the circular polarity high band signals without assistance from the internal shape of the horn.

The specific embodiments shown in the figures are designed to simultaneously communicate low-band signals with linear polarity and high-band signals with circular polarity. Although these antennas are capable of bidirectional communications, the antennas are generally described with reference to the reception communication direction for descriptive convenience. It should be understood that the size and shape of each antenna is specifically designed for the intended operational frequencies of the antenna, but can be readily changed to be appropriate of other operational frequencies. In addition, the figures illustrate the shape of the internal surfaces (i.e., wave guide surfaces) of the antennas without illustrating any external features. Therefore, the antennas shown may be cast, cut or machined into single or multiple blocks of material (typically aluminum or zinc alloy) as desired. It will be appreciated that the internal wave guide surfaces of the antennas shown in the figures control the operational aspects of the antennas and the external features of the antennas typically provide mounting structures but have no appreciable affect on the wave guide operation of the antennas. In general, the antennas shown in the figures are described with reference to a Cartesian coordinate system 5 illustrated on many of the figures. In the Cartesian coordinate system, the "Z" direction represents the intended signal propagation or "bore sight" direction of the antenna as a matter of convention and reference is made to various directions and planes in the Cartesian coordinate system to aid in the description of the structures.

Figure 1C:
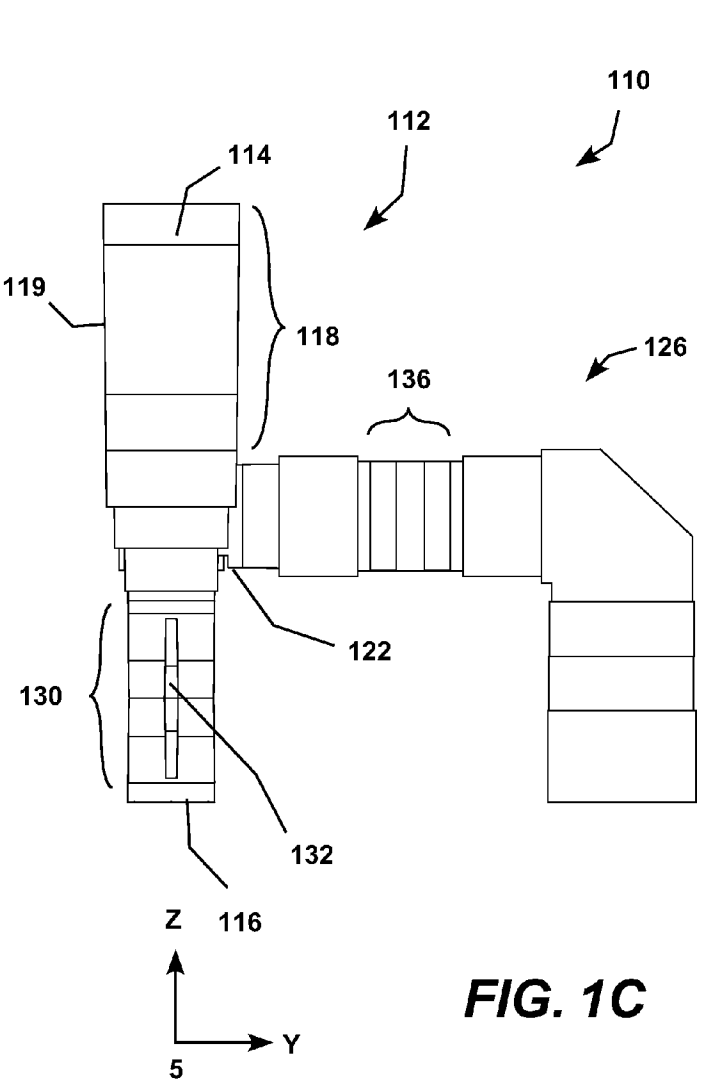
FIG. 1C is a "Y-Z" plane side view of the first multi-band antenna.
Figure 1B:
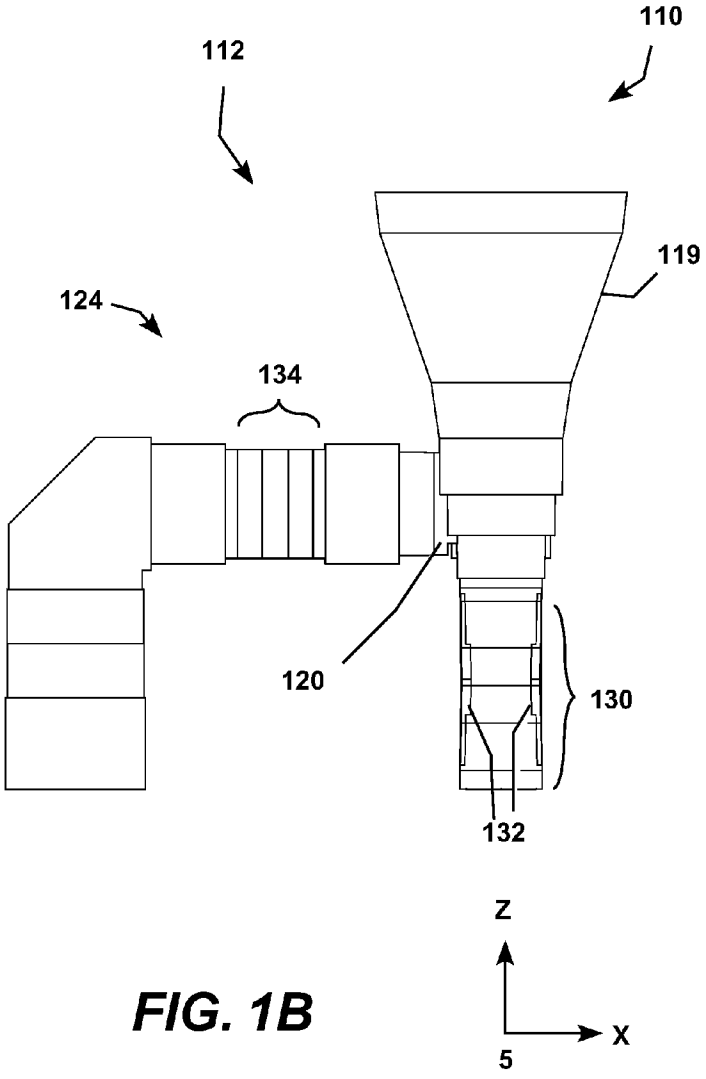
FIG. 1B is an "X-Z" plane side view of the first multi-band antenna.
Figure 1E:
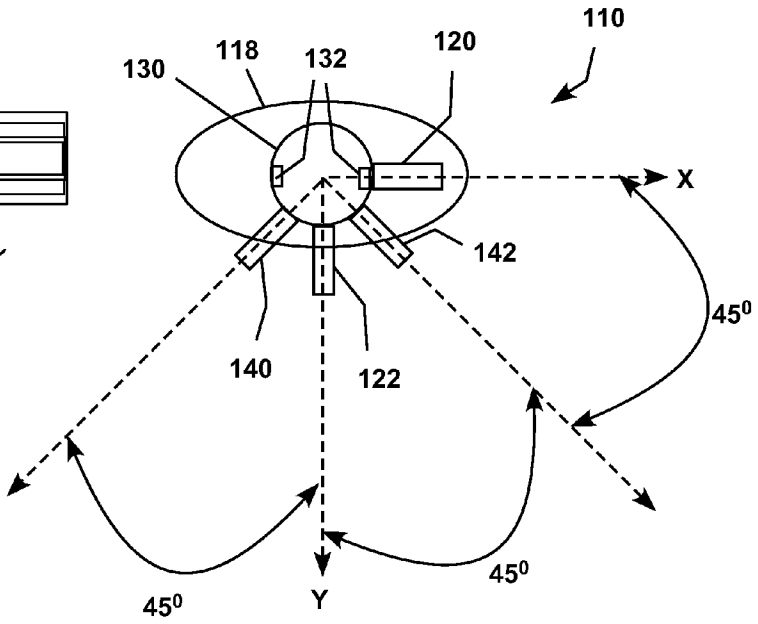
FIG. 1E is a conceptual "X-Y" plane top view of the first multi-band antenna illustrating the locations and orientations of the high-band and low-band ports.
Figure 1D:
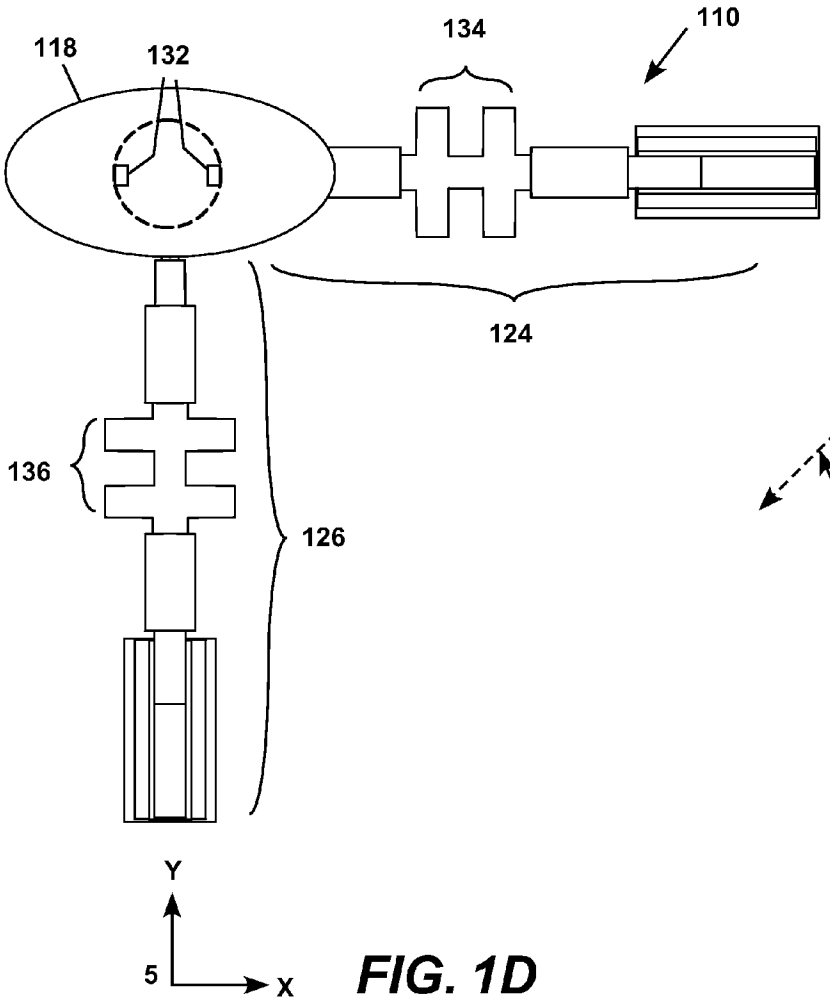
FIG. 1D is an "X-Y" plane top view of the first multi-band antenna.

FIGS. 1A through 1H illustrate a first multi-band antenna 110 for simultaneously communicating low-band signals with linear polarity and high-band signals with circular polarity. FIG. 1A is perspective view of the antenna 110 with the "Z" direction representing the signal propagation direction of the antenna. FIG. 1B is an "X-Z" plane side view of the antenna 110, FIG. 1C is a "Y-Z" plane side view of the antenna 110, and FIG. 1D is an "X-Y" plane top view of the antenna 110. The antenna 110 includes a wave guide horn 112 extending in the signal propagation direction from a reception end 114 shown at the top of FIG. 1A to high-band port 116 shown at the bottom of FIG. 1A. The wave guide horn 112 includes a first transition section 118 with an upper reception section 119 having an oblong, generally elliptical cross-section transverse to the signal propagation direction (i.e., an oblong or elliptical shape in the "X-Y" plane) that decreases in oblong extent until it merges into a circular profile. The oblong cross-section is defined by a major axis in the "X" direction and a minor axis in the "Y" direction.

The first transition section 118 extends from the reception end 114 to low-band ports 120, 122. The first low-band port 120 lies in the "X-Z" plane and leads to a first low-band wave guide 124 for communicating a first linear polarity (e.g., horizontal or "H" polarity) of the low-band signal. The second low-band port 122 lies in the "Y-Z" plane and leads to a second low-band wave guide 126 for communicating a second linear polarity (e.g., vertical or "V" polarity) of the low-band signal. The first low-band wave guide 124 includes a high-band rejection filter 134 to prevent the high-band signal from propagating through the low-band wave guide 124, and the second low-band wave guide 126 includes a high-band rejection filter 136 to prevent the high-band signal from propagating through the low-band wave guide 126. As the first transition section 118 is located between the reception end 114 and the low-band ports 120, 122 (i.e., above the low-band ports), both the high-band and low-band signals propagate through the first transition section 118.

The horn 112 further includes a second transition section 130 that extends from below the low-band ports 120, 122 to the high-band port 116. As the second transition section 130 is located between the low-band ports 120, 122 and the high-band port 116, (i.e., below the low-band ports), only the high-band signal propagate through the second transition section 130. It should be noted here that a specific structure for the high-band port 116 is not illustrated and is typically implemented in a structure immediately following the high-band port 116, such as a high-band wave guide, low-noise amplifier, or other suitable structure. Any type of suitable high-band pickups may be used, such as probes, wave guide openings, a wave guide divided by a septum, and so forth.

FIG. 1B shows that the major axis of the reception section 119 flairs substantially in the "X" direction, while FIG. 1C shows that the minor axis of the reception section does not flair substantially in the "Y" direction. FIG. 1E is a conceptual "X-Y" plane top view of the antenna 110 illustrating the locations and orientations of the high-band and low-band ports. The first low-band output port 120 is aligned in the "X" direction and the second low-band output port 122 is aligned in the "Y" direction. As a result, the decreasing oblong shape of the reception section 119 does not affect the polarity of the linear polarity low-band signal. The high-band output ports 140, 142, on the other hand, are aligned at 45 degrees to the "Y" and "X" axes, respectively. The decreasing oblong shape of the reception section 119 therefore differentially phase shifts the linear components of the circular polarity high-band signal as the signal propagates through the oblong reception section 119. The length, shape and taper of the reception section 119 is specifically designed to impart a desired amount of differential phase shift to the linear components of the circular polarity high-band signal as the high-band signal propagates through the oblong reception section 119.

In this particular embodiment, the oblong reception section 119 imparts 130 degrees of differentially phase shift to the linear components of the circular polarity high-band signal and the second transition section 130 includes a set of ridges 132 that impart 40 degrees of differentially phase shift to the linear components of the circular polarity high-band signal in the opposite direction (i.e., negative 40 degrees, or 40 degrees oppositely sloped) for a total of 90 degrees, which polarizes the circular polarity high-band signal into linear polarities at the high-band port 116. "Over rotation" of the differential phase shift in the oblong reception section 119 followed by "oppositely sloped" rotation in the reverse direction in the lower transition section 530 improves the high-band gain and bandwidth performance of the antenna, as described in U.S. Pat. Nos. 7,239,285 and 7,642,982.

Figure 1H:
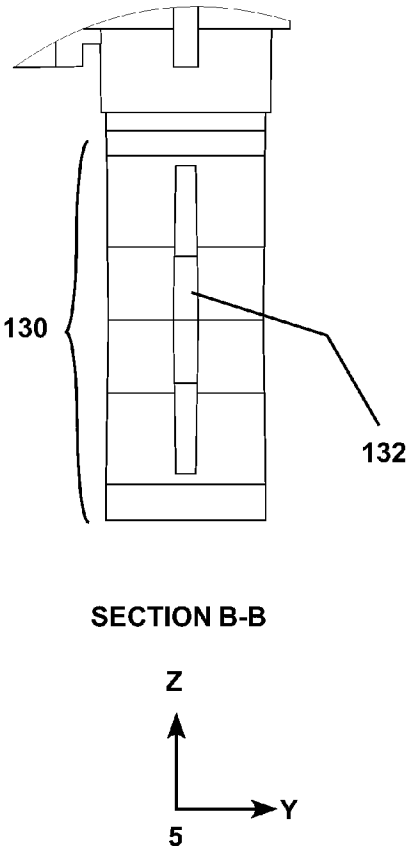
FIG. 1H is a "Y-Z" plane cross-section side view further illustrating the internal features of the transition section of the first multi-band antenna.
Figure 1G:
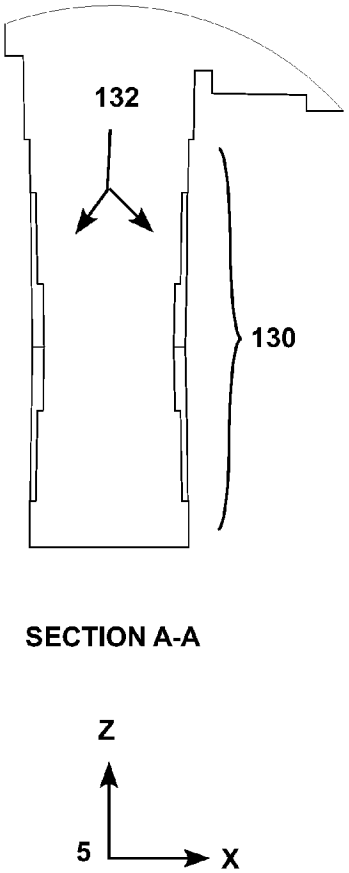
FIG. 1G is an "X-Z" plane cross-section side view illustrating internal features of a transition section of the first multi-band antenna.
Figure 1F:
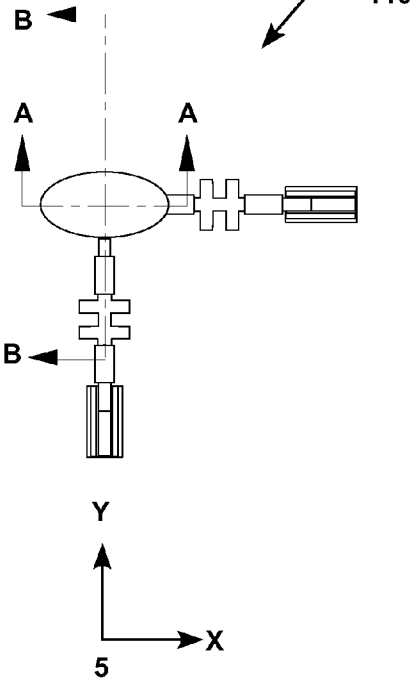
FIG. 1F is a conceptual "X-Y" plane top view of the first multi-band antenna illustrating the location of section lines.

FIG. 1F is a conceptual "X-Y" plane top view of the multi-band antenna 110 illustrating the location of section lines A-A and B-B. FIG. 1G is an "X-Z" plane cross-section side view illustrating internal features of the transition section 130 as viewed along section line A-A and FIG. 1H is a "Y-Z" plane cross-section side view further illustrating the internal features of the transition section 130 as viewed along section line B-B. In this particular embodiment, the ridges 132 lie in the "X-Z" plane and are aligned in the "X" direction. The size, shape and locations of the ridges are specifically designed to impart the desired differential phase shift to the linear components of the circular polarity high-band signal as the high-band signal propagates through the second transition section 130.

Figure 2A:
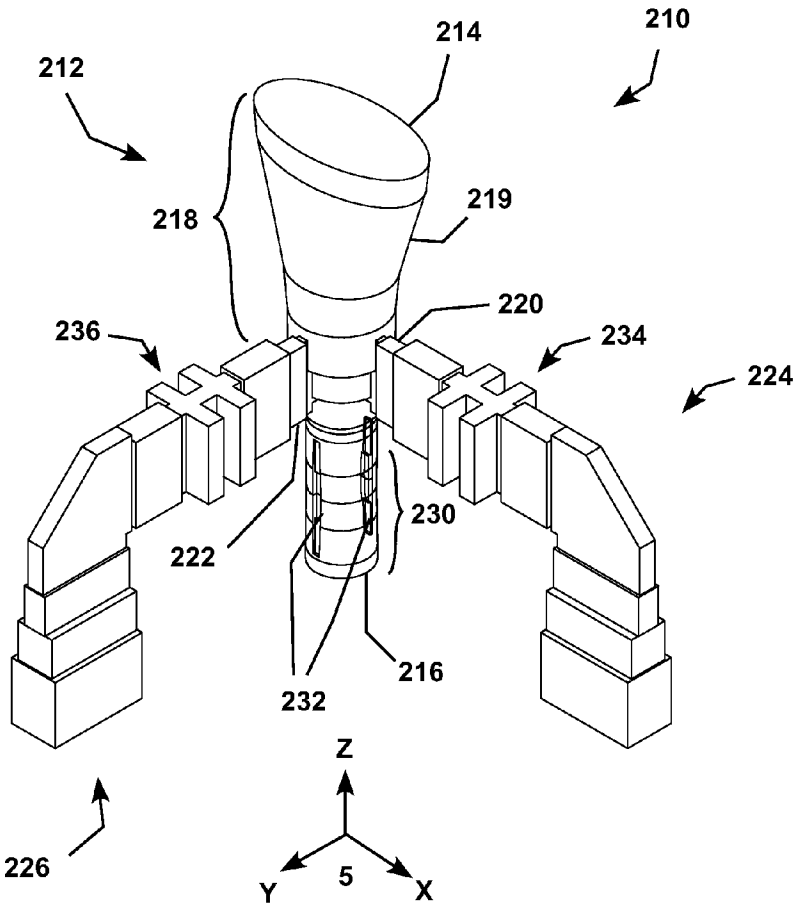
FIG. 2A is perspective view of a second multi-band antenna with an oblong horn designed to simultaneously communicate high high-band signals with circular and linear polarity and low-band signals with linear polarity.
Figure 2C:
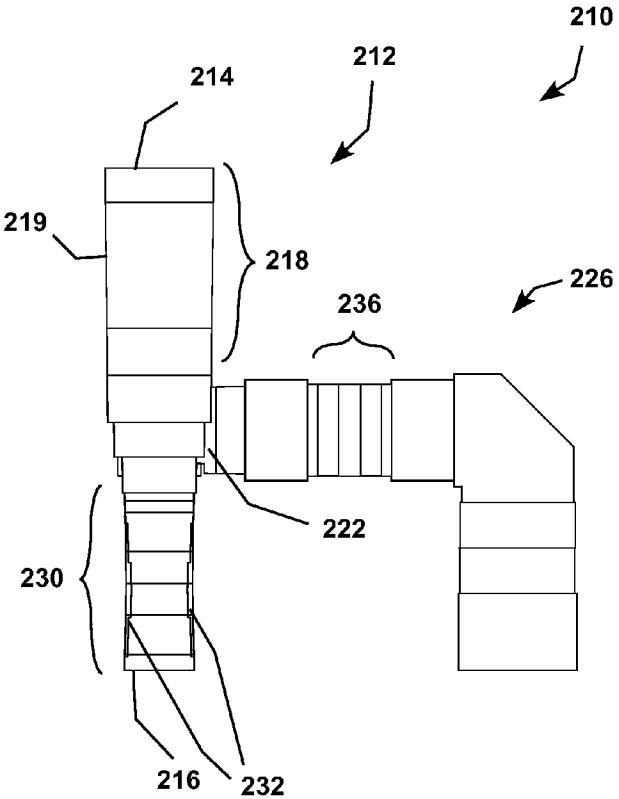
FIG. 2C is a "Y-Z" plane side view of the second multi-band antenna.
Figure 2B:
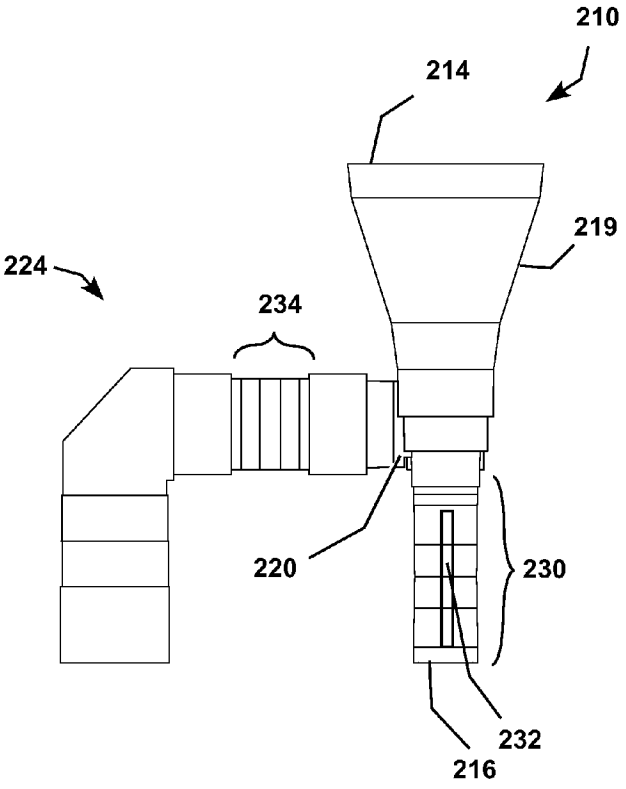
FIG. 2B is an "X-Z" plane side view of the second multi-band antenna.
Figure 2E:
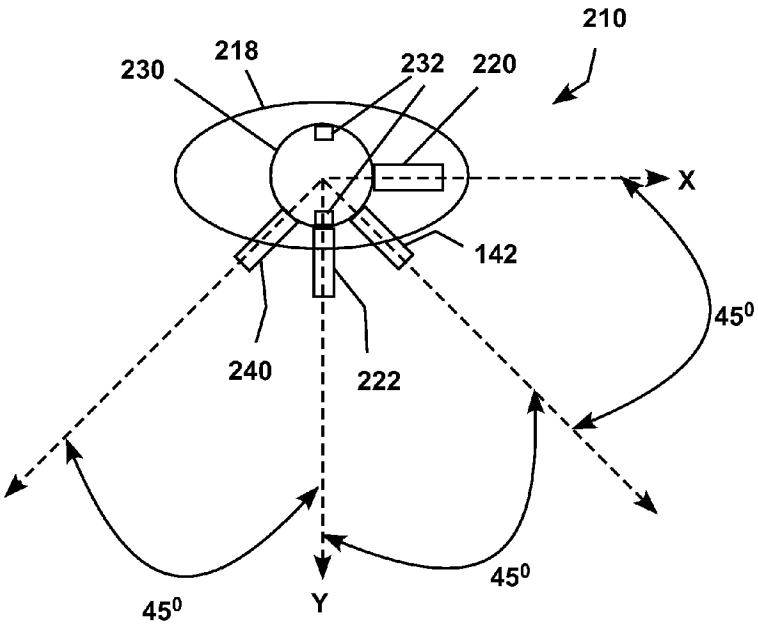
FIG. 2E is a conceptual "X-Y" plane top view of the second multi-band antenna illustrating the locations and orientations of the high-band and low-band ports.
Figure 2D:
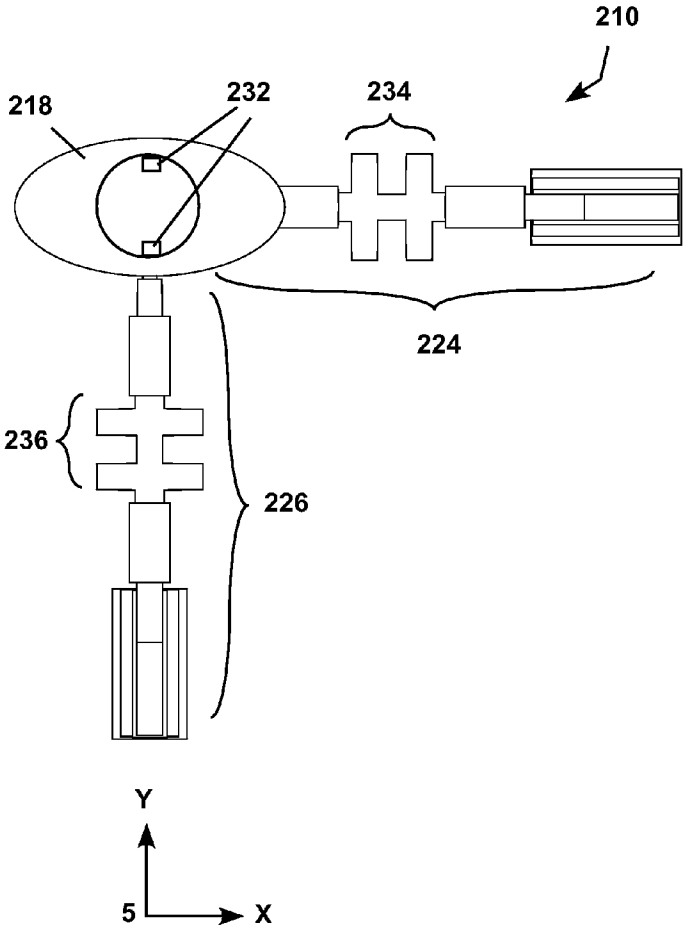
FIG. 2D is an "X-Y" plane top view of the second multi-band antenna.
Figure 2H:
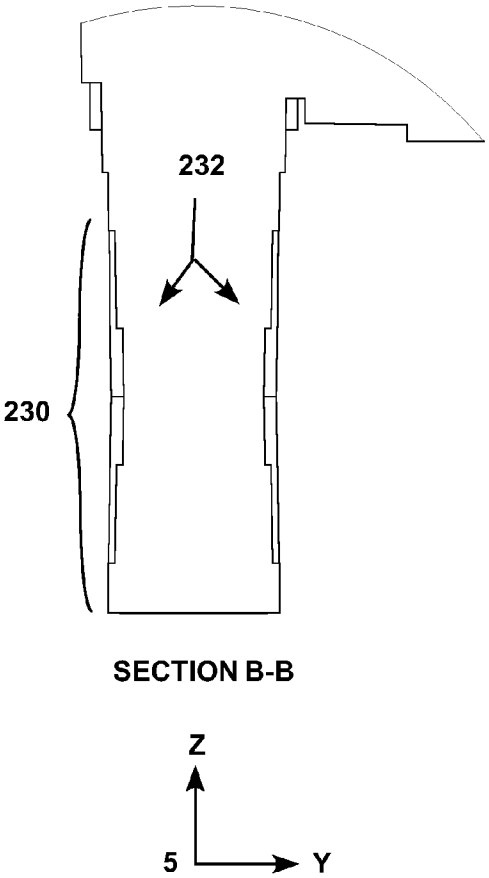
FIG. 2H is a "Y-Z" plane cross-section side view further illustrating the internal features of the transition section of the second multi-band antenna.
Figure 2G:
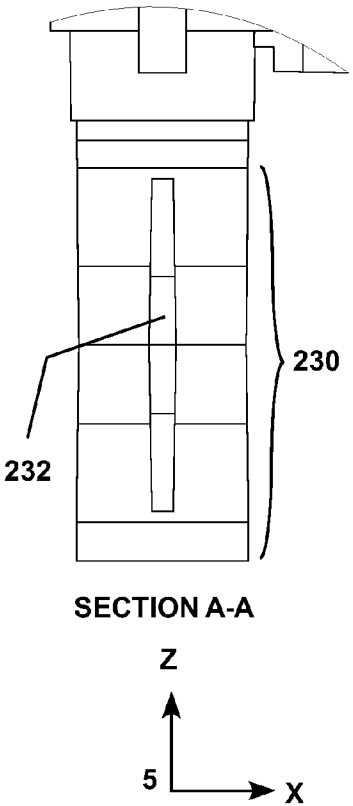
FIG. 2G is an "X-Z" plane cross-section side view illustrating internal features of a transition section of the second multi-band antenna.
Figure 2F:
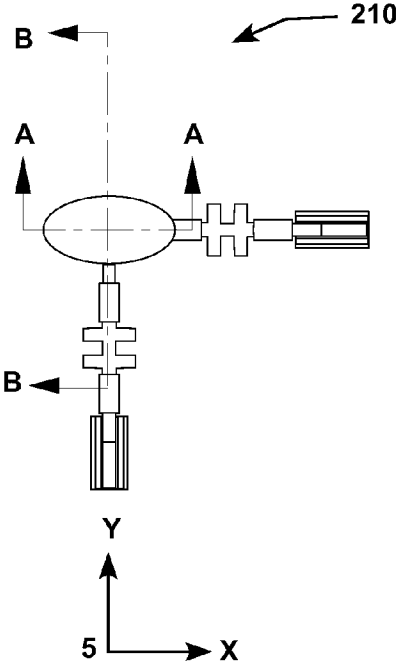
FIG. 2F is a conceptual "X-Y" plane top view of the second multi-band antenna illustrating the location of section lines.

FIGS. 2A through 2H illustrate a second multi-band antenna 210 for simultaneously communicating low-band signals with linear polarity and high-band signals with circular polarity. FIG. 2A is perspective view of the antenna 210 with the "Z" direction representing the signal propagation direction of the antenna. FIG. 2B is an "X-Z" plane side view of the antenna 210, FIG. 2C is a "Y-Z" plane side view of the antenna 210, and FIG. 2D is an "X-Y" plane top view of the antenna 210. The antenna 210 includes a wave guide horn 212 extending in the signal propagation direction from a reception end 214 shown at the top of FIG. 2A to high-band port 216 shown at the bottom of FIG. 2A. The wave guide horn 212 includes a first transition section 218 with an upper reception section 219 having an oblong cross-section transverse to the signal propagation direction (i.e., an oblong shape in the "X-Y" plane) that decreases in oblong extent until it merges into a circular profile. The oblong cross-section is defined by a major axis in the "X" direction and a minor axis in the "Y" direction.

The first transition section 218 extends from the reception end 214 to low-band ports 220, 222. The first low-band port 220 lies in the "X-Z" plane and leads to a first low-band wave guide 224 for communicating a first linear polarity (e.g., horizontal or "H" polarity) of the low-band signal. The second low-band port 222 lies in the "Y-Z" plane and leads to a second low-band wave guide 226 for communicating a second linear polarity (e.g., vertical or "V" polarity) of the low-band signal. The first low-band wave guide 224 includes a high-band rejection filter 234 to prevent the high-band signal from propagating through the low-band wave guide 224, and the second low-band wave guide 226 includes a high-band rejection filter 236 to prevent the high-band signal from propagating through the low-band wave guide 226. As the first transition section 218 is located between the reception end 214 and the low-band ports 220, 222 (i.e., above the low-band ports), both the high-band and low-band signals propagate through the first transition section 218.

The horn 212 further includes a second transition section 230 that extends from below the low-band ports 220, 222 to the high-band port 216. As the second transition section 230 is located between the low-band ports 220, 222 and the high-band port 216, (i.e., below the low-band ports), only the high-band signal propagate through the second transition section 230. It should be noted here that a specific structure for the high-band port 216 is not illustrated and is typically implemented in a structure immediately following the high-band port 216, such as a high-band wave guide, low-noise amplifier, or other suitable structure. Any type of suitable high-band pickups may be used, such as probes, wave guide openings, a wave guide divided by a septum, and so forth.

FIG. 2B shows that the major axis of the reception section 219 flairs substantially in the "X" direction, while FIG. 2C shows that the minor axis of the reception section does not flair substantially in the "Y" direction. FIG. 2E is a conceptual "X-Y" plane top view of the antenna 210 illustrating the locations and orientations of the high-band and low-band ports. The first low-band output port 220 is aligned in the "X" direction and the second low-band output port 222 is aligned in the "Y" direction. As a result, the decreasing oblong shape of the reception section 219 does not affect the polarity of the linear polarity low-band signal. The high-band output ports 240, 242, on the other hand, are aligned at 45 degrees to the "Y" and "X" axes, respectively. The decreasing oblong shape of the reception section 219 therefore differentially phase shifts the linear components of the circular polarity high-band signal as the signal propagates through the oblong reception section 219. The length, shape and taper of the reception section 219 is specifically designed to impart a desired amount of differential phase shift to the linear components of the circular polarity high-band signal as the high-band signal propagates through the oblong reception section 219.

In this particular embodiment, the oblong reception section 219 imparts 60 degrees of differentially phase shift to the linear components of the circular polarity high-band signal and the second transition section 230 includes a set of ridges 232 that impart 30 degrees of differentially phase shift to the linear components of the circular polarity high-band signal in the same direction (i.e., additive 40 degrees) for a total of 90 degrees, which polarizes the circular polarity high-band signal into linear polarities at the high-band port 216.

FIG. 1F is a conceptual "X-Y" plane top view of the multi-band antenna 210 illustrating the location of section lines A-A and B-B. FIG. 1G is an "X-Z" plane cross-section side view illustrating internal features of the transition section 230 as viewed along section line A-A and FIG. 1H is a "Y-Z" plane cross-section side view further illustrating the internal features of the transition section 230 as viewed along section line B-B. In this particular embodiment, the ridges 232 lie in the "Y-Z" plane and are aligned in the "Y" direction. The size, shape and locations of the ridges are specifically designed to impart the desired differential phase shift to the linear components of the circular polarity high-band signal as the high-band signal propagates through the second transition section 230.

Figure 3A:
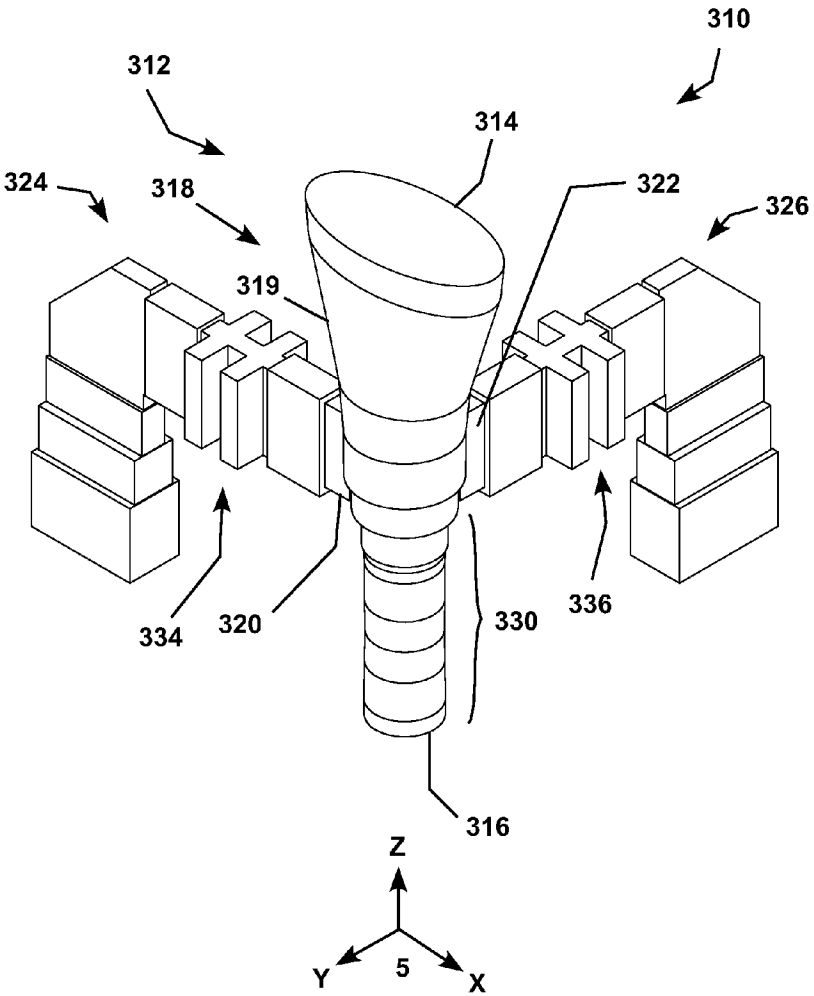
FIG. 3A is perspective view of a third multi-band antenna with an oblong horn designed to simultaneously communicate high high-band signals with circular and linear polarity and low-band signals with linear polarity.
Figure 3C:
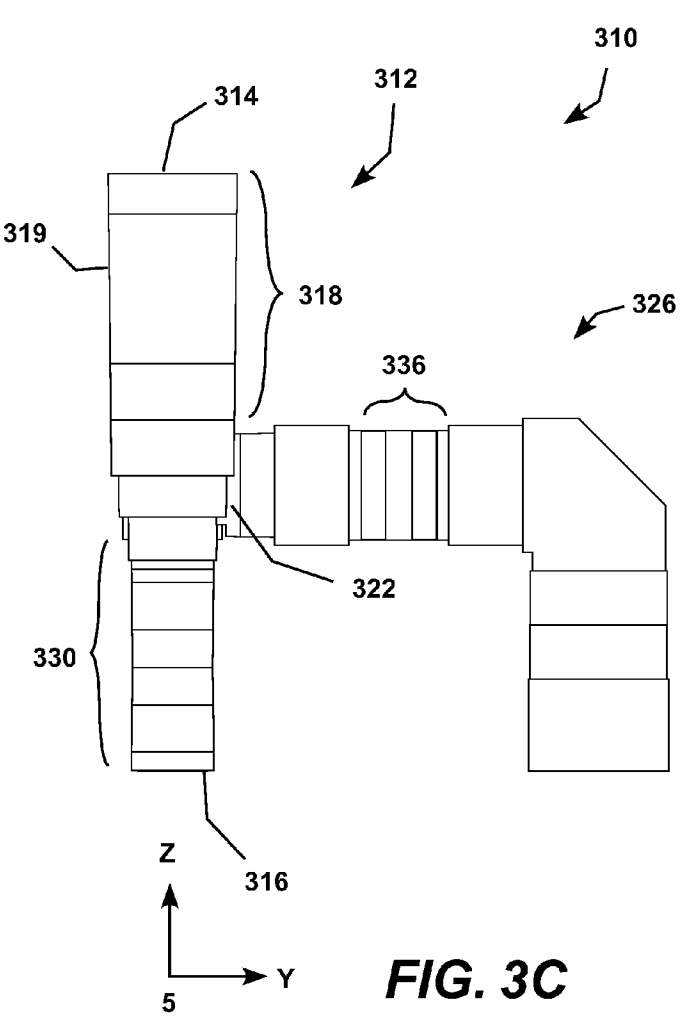
FIG. 3C is a "Y-Z" plane side view of the third multi-band antenna.
Figure 3B:
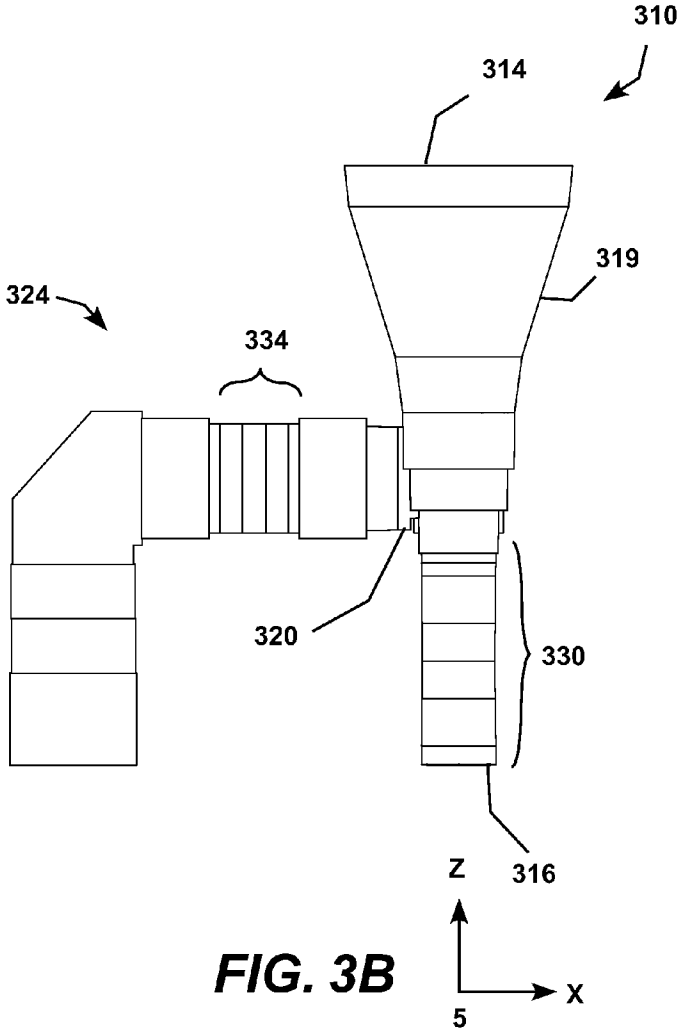
FIG. 3B is an "X-Z" plane side view of the third multi-band antenna.
Figure 3E:
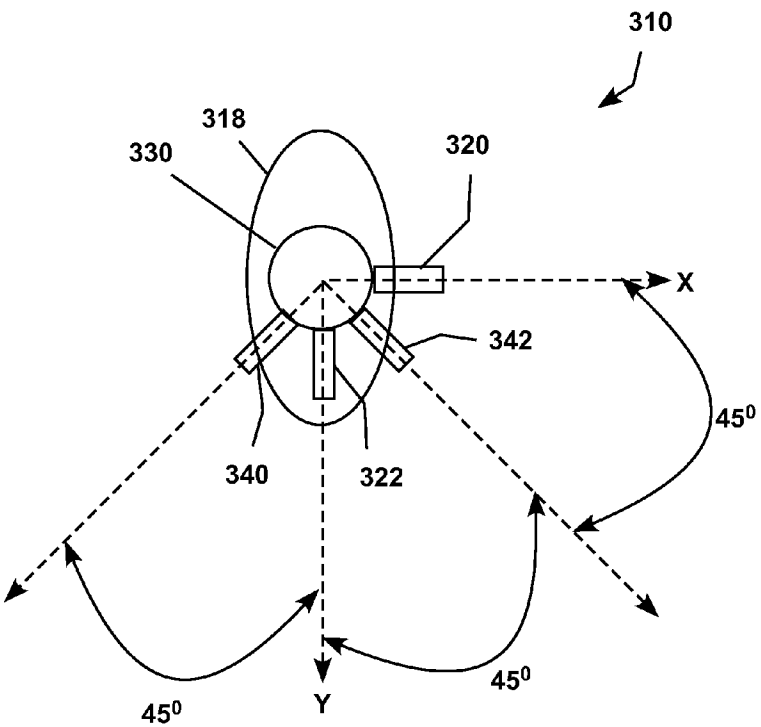
FIG. 3E is a conceptual "X-Y" plane top view of the third multi-band antenna illustrating the locations and orientations of the high-band and low-band ports.
Figure 3D:
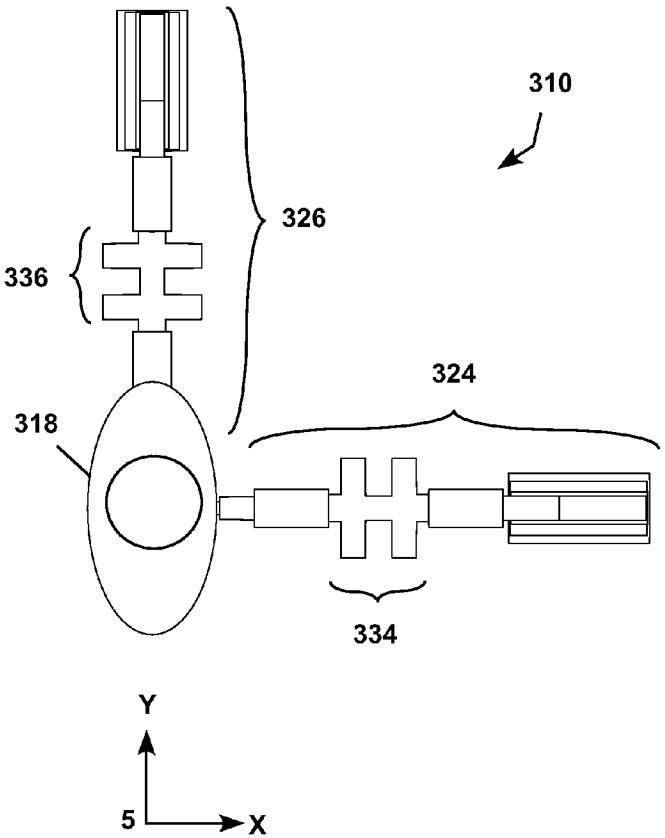
FIG. 3D is an "X-Y" plane top view of the third multi-band antenna.

FIGS. 3A through 3E illustrate a third multi-band antenna 310 for simultaneously communicating low-band signals with linear polarity and high-band signals with circular polarity. FIG. 3A is perspective view of the antenna 310 with the "Z" direction representing the signal propagation direction of the antenna. FIG. 3B is an "X-Z" plane side view of the antenna 310, FIG. 3C is a "Y-Z" plane side view of the antenna 310, and FIG. 3D is an "X-Y" plane top view of the antenna 310. The antenna 310 includes a wave guide horn 312 extending in the signal propagation direction from a reception end 314 shown at the top of FIG. 3A to high-band port 316 shown at the bottom of FIG. 3A. The wave guide horn 312 includes a first transition section 318 with an upper reception section 319 having an oblong cross-section transverse to the signal propagation direction (i.e., an oblong shape in the "X-Y" plane) that decreases in oblong extent until it merges into a circular profile. The oblong cross-section is defined by a major axis in the "X" direction and a minor axis in the "Y" direction.

The first transition section 318 extends from the reception end 314 to low-band ports 320, 322. The first low-band port 320 lies in the "X-Z" plane and leads to a first low-band wave guide 324 for communicating a first linear polarity (e.g., horizontal or "H" polarity) of the low-band signal. The second low-band port 322 lies in the "Y-Z" plane and leads to a second low-band wave guide 326 for communicating a second linear polarity (e.g., vertical or "V" polarity) of the low-band signal. The first low-band wave guide 324 includes a high-band rejection filter 334 to prevent the high-band signal from propagating through the low-band wave guide 324, and the second low-band wave guide 326 includes a high-band rejection filter 336 to prevent the high-band signal from propagating through the low-band wave guide 326. As the first transition section 318 is located between the reception end 314 and the low-band ports 320, 222 (i.e., above the low-band ports), both the high-band and low-band signals propagate through the first transition section 318.

The horn 312 further includes a second transition section 330 that extends from below the low-band ports 320, 322 to the high-band port 316. As the second transition section 330 is located between the low-band ports 320, 322 and the high-band port 316, (i.e., below the low-band ports), only the high-band signal propagate through the second transition section 330. It should be noted here that a specific structure for the high-band port 316 is not illustrated and is typically implemented in a structure immediately following the high-band port 316, such as a high-band wave guide, low-noise amplifier, or other suitable structure. Any type of suitable high-band pickups may be used, such as probes, wave guide openings, a wave guide divided by a septum, and so forth.

FIG. 3B shows that the major axis of the reception section 319 flairs substantially in the "X" direction, while FIG. 2C shows that the minor axis of the reception section does not flair substantially in the "Y" direction. FIG. 2E is a conceptual "X-Y" plane top view of the antenna 310 illustrating the locations and orientations of the high-band and low-band ports. The first low-band output port 320 is aligned in the "X" direction and the second low-band output port 322 is aligned in the "Y" direction. As a result, the decreasing oblong shape of the reception section 319 does not affect the polarity of the linear polarity low-band signal. The high-band output ports 340, 342, on the other hand, are aligned at 45 degrees to the "Y" and "X" axes, respectively. The decreasing oblong shape of the reception section 319 therefore differentially phase shifts the linear components of the circular polarity high-band signal as the signal propagates through the oblong reception section 319. The length, shape and taper of the reception section 319 is specifically designed to impart a desired amount of differential phase shift to the linear components of the circular polarity high-band signal as the high-band signal propagates through the oblong reception section 319.

In this particular embodiment, the oblong reception section 319 imparts 90 degrees of differentially phase shift to the linear components of the circular polarity high-band signal and the second transition section 330 does not includes any ridges to further differentially phase shift the linear components of the circular polarity high-band signal. As a result, in this embodiment the oblong reception section 319 alone polarizes the circular polarity high-band signal into linear polarities at the high-band port 316.

Figure 4B:
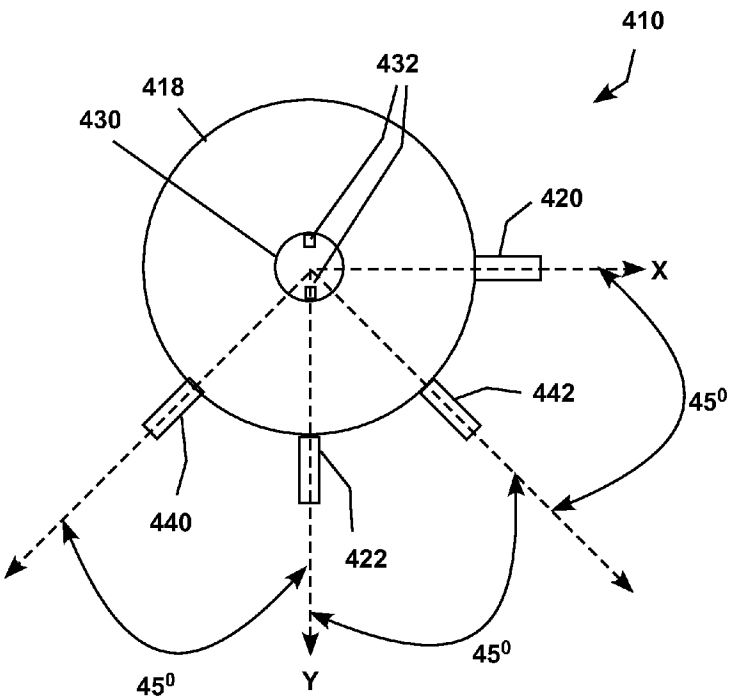
FIG. 4B is a conceptual "X-Y" plane top view of the fourth multi-band antenna illustrating the locations and orientations of the high-band and low-band ports.
Figure 4A:
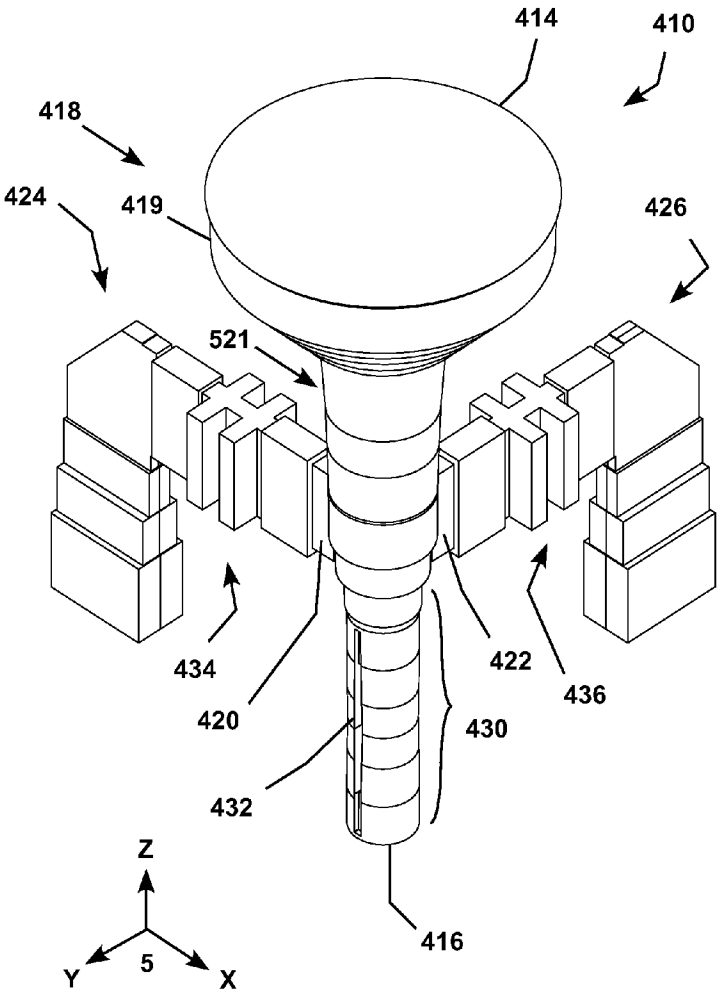
FIG. 4A is perspective view of a fourth multi-band antenna with a circular horn designed to simultaneously communicate high high-band signals with circular and linear polarity and low-band signals with linear polarity.

FIGS. 4A through 4E illustrate a fourth multi-band antenna 410 for simultaneously communicating low-band signals with linear polarity and high-band signals with circular polarity. FIG. 4A is perspective view of the antenna 410 with the "Z" direction representing the signal propagation direction of the antenna. The antenna 410 includes a wave guide horn 412 extending in the signal propagation direction from a reception end 414 shown at the top of FIG. 4A to high-band port 416 shown at the bottom of FIG. 4A. The wave guide horn 412 includes a first transition section 418 with an upper reception section 419 having a circular cross-section transverse to the signal propagation direction that decreases in radial extent until it merges into a smaller circular profile. A wave guide section 421 with a substantially constant radius transverse to the signal propagation section extends from a larger reception cone to the low-band ports 420, 422.

The first transition section 418 extends from the reception end 414 to the low-band ports 420, 422. The first low-band port 420 lies in the "X-Z" plane and leads to a first low-band wave guide 424 for communicating a first linear polarity (e.g., horizontal or "H" polarity) of the low-band signal. The second low-band port 422 lies in the "Y-Z" plane and leads to a second low-band wave guide 426 for communicating a second linear polarity (e.g., vertical or "V" polarity) of the low-band signal. The first low-band wave guide 424 includes a high-band rejection filter 434 to prevent the high-band signal from propagating through the low-band wave guide 424, and the second low-band wave guide 426 includes a high-band rejection filter 436 to prevent the high-band signal from propagating through the low-band wave guide 426. As the first transition section 418 is located between the reception end 414 and the low-band ports 420, 422 (i.e., above the low-band ports), both the high-band and low-band signals propagate through the first transition section 418.

Figure 4E:
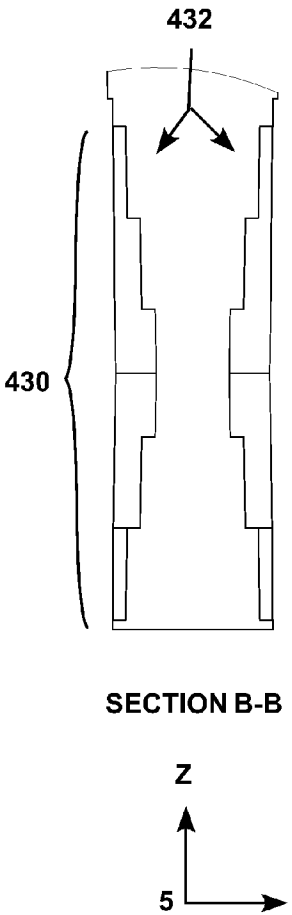
FIG. 4E is a "Y-Z" plane cross-section side view further illustrating the internal features of the transition section of the fourth multi-band antenna.

The horn 412 further includes a second transition section 430 that extends from below the low-band ports 420, 422 to the high-band port 416. As the second transition section 430 is located between the low-band ports 420, 422 and the high-band port 416, (i.e., below the low-band ports), only the high-band signal propagate through the second transition section 430. In this particular embodiment, the transition section 430 includes a pair of ridges 432 (only one ridge is illustrated in FIG. 4A for clarity, while both ridges are illustrated in FIG. 4E) that impart 90 degrees of differentially phase shift to the linear components of the circular polarity high-band signal to polarize the high-band signal as it propagates through the antenna 410. It should be noted here that a specific structure for the high-band port 416 is not illustrated and is typically implemented in a structure immediately following the high-band port 416, such as a high-band wave guide, low-noise amplifier, or other suitable structure. Any type of suitable high-band pickups may be used, such as probes, wave guide openings, a wave guide divided by a septum, and so forth.

FIG. 4B is a conceptual "X-Y" plane top view of the antenna 410 illustrating the locations and orientations of the high-band and low-band ports. The first low-band output port 420 is aligned in the "X" direction and the second low-band output port 422 is aligned in the "Y" direction. The decreasing circular shape of the reception section 419 does not affect the polarity of the linear polarity low-band signal. The high-band output ports 440, 442, on the other hand, are aligned at 45 degrees to the "Y" and "X" axes, respectively. As a result, any ridges in the internal profile of the antenna that are aligned with the "X' axis or the "Y" axis do not affect the polarity of the linearly polarity low-band signal, while they differentially phase shift the linear components of the circular polarity high-band signal as the signal propagates through the antenna. The length, shape and taper of the ridges are therefore specifically designed to impart 90 degrees of differential phase shift to the linear components of the circular polarity high-band signal to polarize the high-band signal as it propagates through the antenna 410.

Figure 4D:
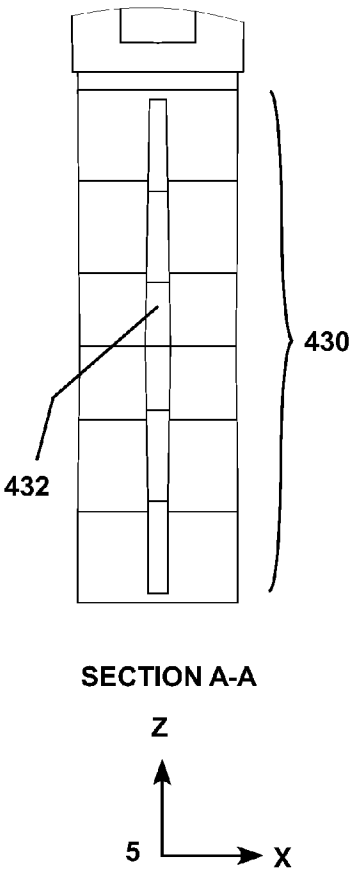
FIG. 4D is an "X-Z" plane cross-section side view illustrating internal features of a transition section of the fourth multi-band antenna.
Figure 4C:
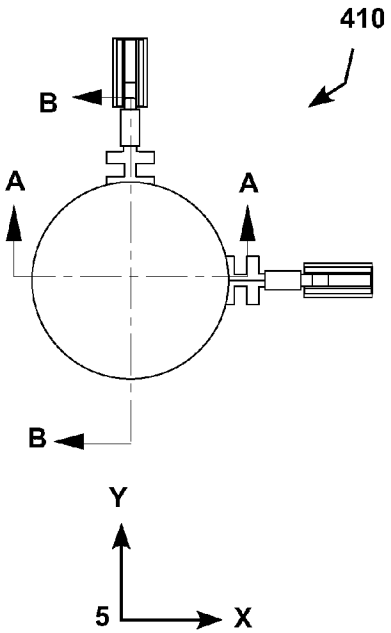
FIG. 4C is a conceptual "X-Y" plane top view of the fourth multi-band antenna illustrating the location of section lines.

FIG. 4C is a conceptual "X-Y" plane top view of the multi-band antenna 410 illustrating the location of section lines A-A and B-B. FIG. 4D is an "X-Z" plane cross-section side view illustrating internal features of the transition section 430 as viewed along section line A-A and FIG. 4C is a "Y-Z" plane cross-section side view further illustrating the internal features of the transition section 430 as viewed along section line B-B. In this particular embodiment, the ridges 432 lie in the "Y-Z" plane and are aligned in the "Y" direction. The size, shape and locations of the ridges are specifically designed to impart the desired 90 differential phase shift to the linear components of the circular polarity high-band signal to polarize the high-band signal as it propagates through the second transition section 430.

Figure 5B:
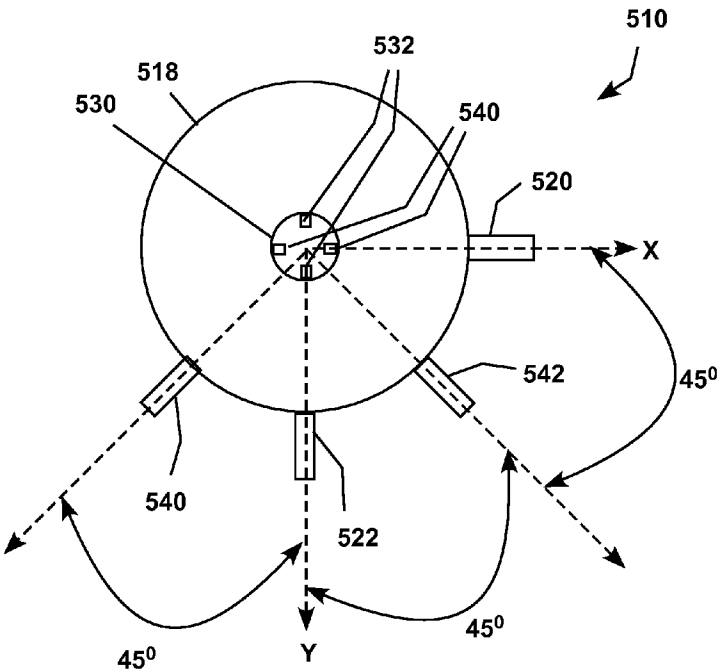
FIG. 5B is a conceptual "X-Y" plane top view of the fifth multi-band antenna illustrating the locations and orientations of the high-band and low-band ports.
Figure 5A:
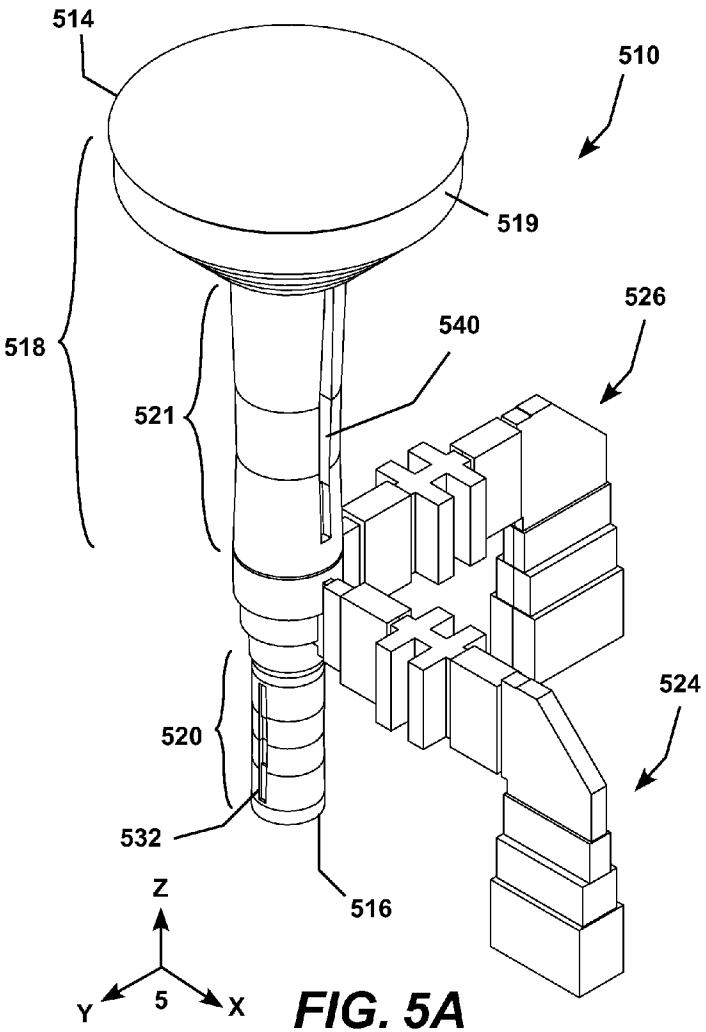
FIG. 5A is perspective view of a fifth multi-band antenna with a circular horn designed to simultaneously communicate high high-band signals with circular and linear polarity and low-band signals with linear polarity.

FIGS. 5A through 5E illustrate a fifth multi-band antenna 510 for simultaneously communicating low-band signals with linear polarity and high-band signals with circular polarity. FIG. 5A is perspective view of the antenna 510 with the "Z" direction representing the signal propagation direction of the antenna. The antenna 510 includes a wave guide horn 512 extending in the signal propagation direction from a reception end 514 shown at the top of FIG. 5A to high-band port 516 shown at the bottom of FIG. 5A. The wave guide horn 512 includes a first transition section 518 with an upper reception section 519 having a circular cross-section transverse to the signal propagation direction that decreases in radial extent until it merges into a smaller circular profile. A wave guide section 521 with a substantially constant radius transverse to the signal propagation section extends from a larger reception cone to the low-band ports 520, 522.

The first transition section 518 extends from the reception end 514 to the low-band ports 520, 522. The first low-band port 520 lies in the "X-Z" plane and leads to a first low-band wave guide 524 for communicating a first linear polarity (e.g., horizontal or "H" polarity) of the low-band signal. The second low-band port 522 lies in the "Y-Z" plane and leads to a second low-band wave guide 526 for communicating a second linear polarity (e.g., vertical or "V" polarity) of the low-band signal. The first low-band wave guide 524 includes a high-band rejection filter 534 to prevent the high-band signal from propagating through the low-band wave guide 524, and the second low-band wave guide 526 includes a high-band rejection filter 536 to prevent the high-band signal from propagating through the low-band wave guide 526. As the first transition section 518 is located between the reception end 514 and the low-band ports 520, 522 (i.e., above the low-band ports), both the high-band and low-band signals propagate through the first transition section 518.

The horn 512 further includes a second transition section 530 that extends from below the low-band ports 520, 522 to the high-band port 516. As the second transition section 530 is located between the low-band ports 520, 522 and the high-band port 516, (i.e., below the low-band ports), only the high-band signal propagate through the second transition section 530. In this particular embodiment, the upper wave guide section 521 includes a first set of ridges 540 (only one ridge is illustrated in FIG. 5A for clarity, while both ridges are illustrated in FIG. 5F), and the lower transition section 430 includes a second pair of ridges 532 (only one ridge is illustrated in FIG. 5A for clarity, while both ridges are illustrated in FIG. 5E) that in combination impart 90 degrees of differentially phase shift to the linear components of the circular polarity high-band signal to polarize the high-band signal as it propagates through the antenna 410. It should be noted here that a specific structure for the high-band port 516 is not illustrated and is typically implemented in a structure immediately following the high-band port 516, such as a high-band wave guide, low-noise amplifier, or other suitable structure. Any type of suitable high-band pickups may be used, such as probes, wave guide openings, a wave guide divided by a septum, and so forth.

FIG. 5B is a conceptual "X-Y" plane top view of the antenna 510 illustrating the locations and orientations of the high-band and low-band ports. The first low-band output port 520 is aligned in the "X" direction and the second low-band output port 522 is aligned in the "Y" direction. The decreasing circular shape of the reception section 519 does not affect the polarity of the linear polarity low-band signal. The high-band output ports 540, 542, on the other hand, are aligned at 45 degrees to the "Y" and "X" axes, respectively. As a result, any ridges in the internal profile of the antenna that are aligned with the "X' axis or the "Y" axis do not affect the polarity of the linearly polarity low-band signal, while they differentially phase shift the linear components of the circular polarity high-band signal as the signal propagates through the antenna. The length, shape and taper of the ridges are therefore specifically designed to impart 90 degrees of differential phase shift to the linear components of the circular polarity high-band signal to polarize the high-band signal as it propagates through the antenna 510.

Figure 5C:
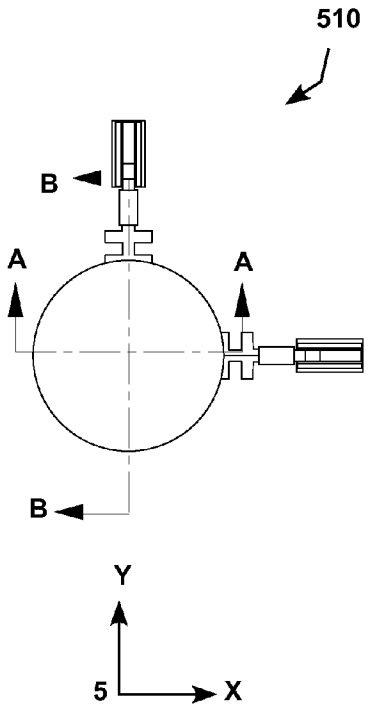
FIG. 5C is a conceptual "X-Y" plane top view of the fifth multi-band antenna illustrating the location of section lines.
Figure 5D:
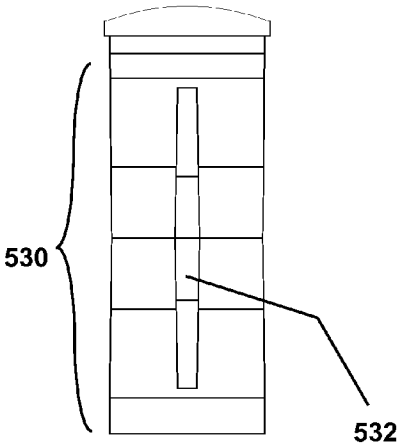
FIG. 5D is an "X-Z" plane cross-section side view illustrating internal features of a first transition section of the fifth multi-band antenna.
Figure 5E:
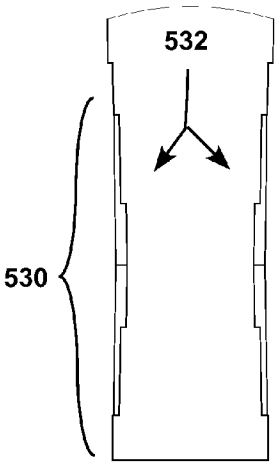
FIG. 5E is a "Y-Z" plane cross-section side view further illustrating the internal features of the first transition section of the fifth multi-band antenna.

FIG. 5C is a conceptual "X-Y" plane top view of the multi-band antenna 510 illustrating the location of section lines A-A and B-B. FIG. 5D is an "X-Z" plane cross-section side view of the lower transition section 530 illustrating internal features of the lower transition section as viewed along section line A-A. FIG. 5E is a "Y-Z" plane cross-section side view of the lower transition section 530 further illustrating the internal features of the lower transition section as viewed along section line B-B. In this particular embodiment, the ridges 532 on the internal surface of the lower transition section 530 lie in the "Y-Z" plane and are aligned in the "Y" direction. The size, shape and locations of the ridges are specifically designed to impart the desired differential phase shift to the linear components of the circular polarity high-band signal to polarize the high-band signal as it propagates through the lower transition section 530.

Figure 5G:
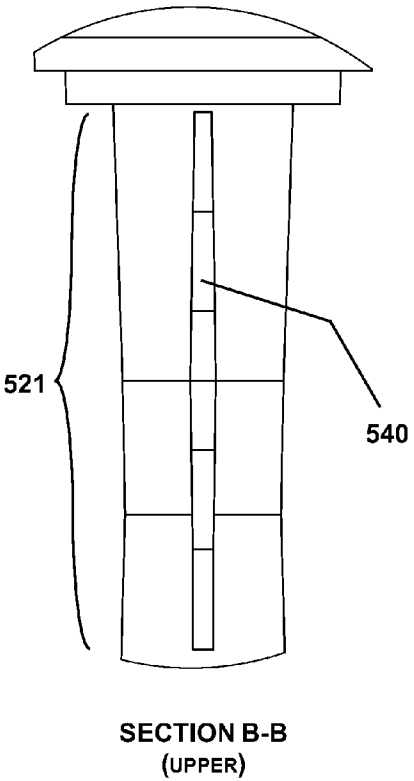
FIG. 5G is a "Y-Z" plane cross-section side view further illustrating the internal features of the second transition section of the fifth multi-band antenna.
Figure 5F:
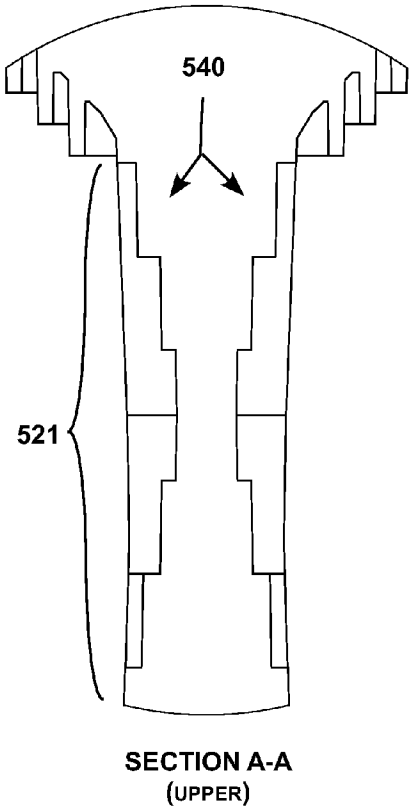
FIG. 5F is an "X-Z" plane cross-section side view illustrating internal features of a second transition section of the fifth multi-band antenna.

FIG. 5F is an "X-Z" plane cross-section side view of the upper wave guide section 521 forming the lower portion of the upper transition section 518 illustrating internal features of the upper wave guide section as viewed along section line A-A. FIG. 5G is a "Y-Z" plane cross-section side view of the upper wave guide section 521 further illustrating the internal features of the upper wave guide section as viewed along section line B-B. In this particular embodiment, the ridges 540 on the internal surface of the upper wave guide section 521 lie in the "X-Z" plane and are aligned in the "Y" direction. The size, shape and locations of the ridges are specifically designed to impart the desired differential phase shift to the linear components of the circular polarity high-band signal as it propagates through the upper wave guide section 521.

In this particular embodiment, the first set of ridges 540 on the interior surface of the upper wave guide section 521 impart 130 degrees of differential phase shift to the linear components of the circular polarity high0band signal, while the second set of ridges 532 on the interior surface of the lower transition section 530 impart 40 degrees of differential phase shift to the linear components of the circular polarity high-band signal in the opposite direction (i.e., negative 40 degrees, or 40 degrees oppositely sloped) for a total of 90 degrees, which polarizes the circular polarity high-band signal into linear polarities at the high-band port 516. "Over rotation" of the differential phase shift in the upper wave guide section 52 followed by "oppositely sloped" rotation in the reverse direction in the lower transition section 530 improves the high-band gain and bandwidth performance of the antenna, as described in U.S. Pat. Nos. 7,239,285 and 7,642,982.

Figure 6B:
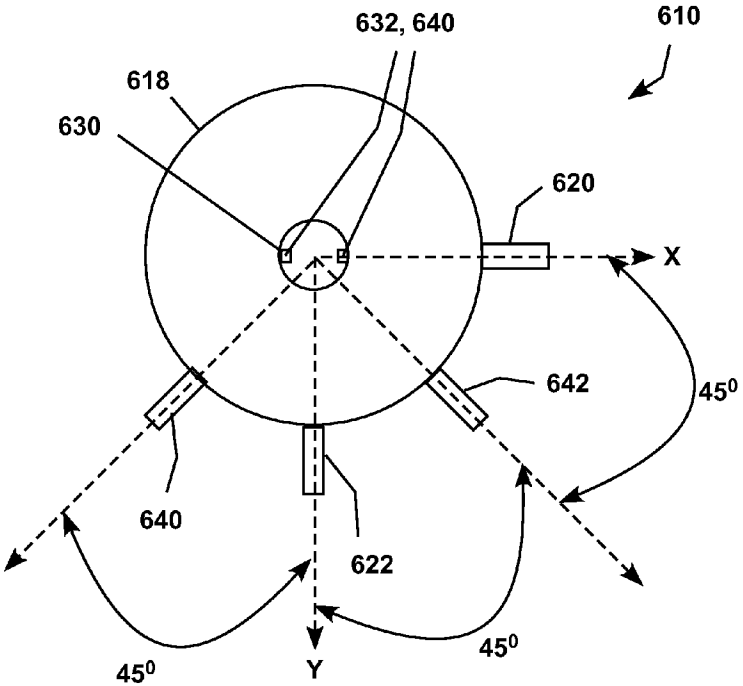
FIG. 6B is a conceptual "X-Y" plane top view of the sixth multi-band antenna illustrating the locations and orientations of the high-band and low-band ports.
Figure 6A:
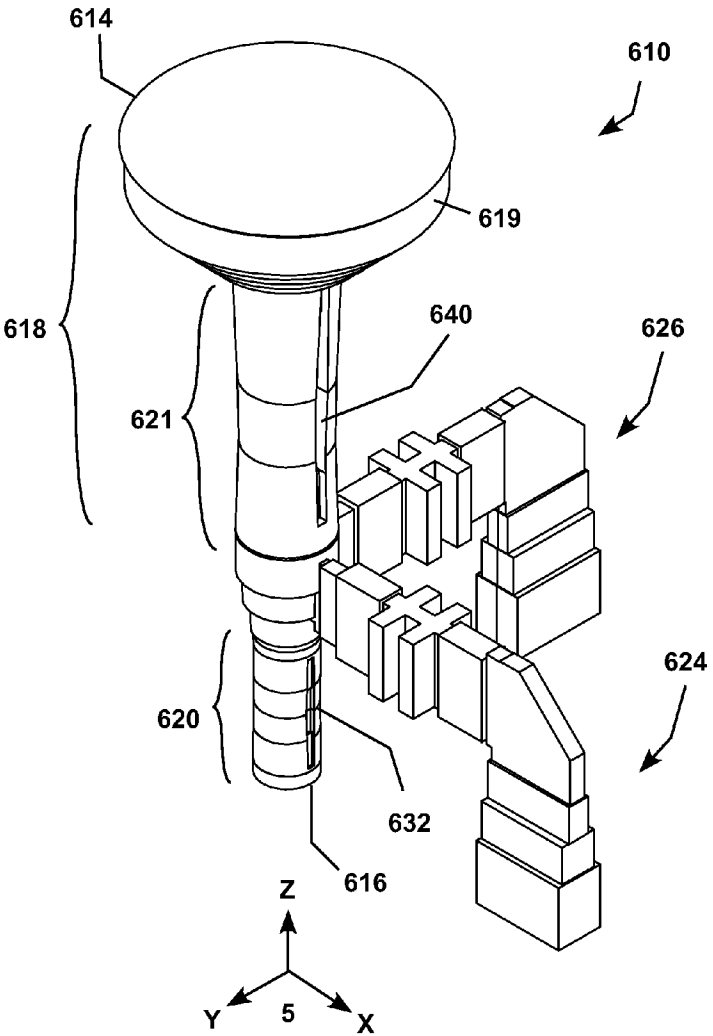
FIG. 6A is perspective view of a sixth multi-band antenna with a circular horn designed to simultaneously communicate high high-band signals with circular and linear polarity and low-band signals with linear polarity.
Figure 6E:
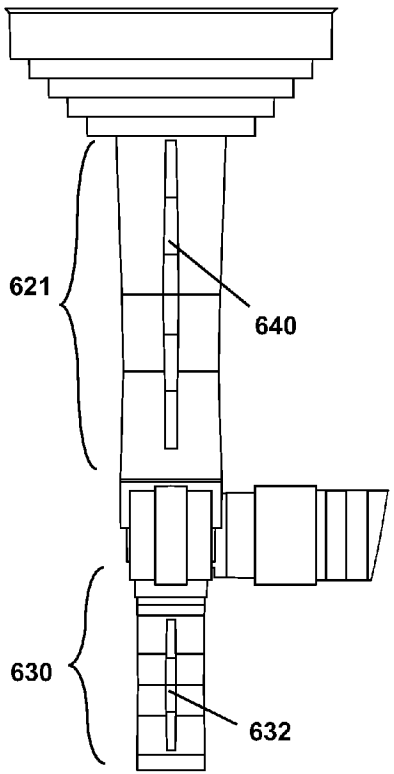
FIG. 6E is a "Y-Z" plane cross-section side view further illustrating the internal features of the first and second transitions sections of the sixth multi-band antenna.
Figure 6D:
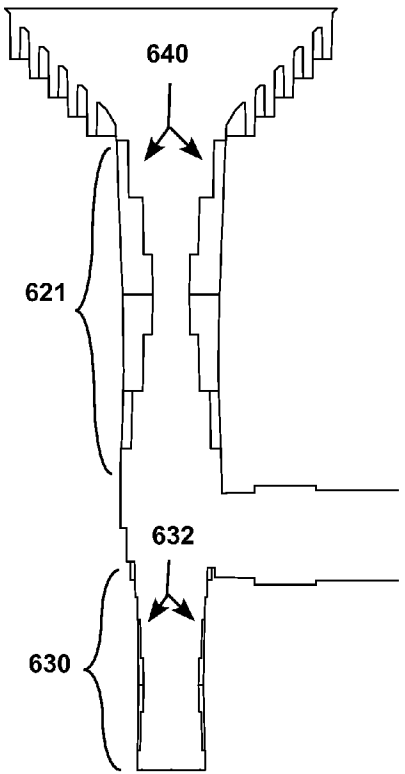
FIG. 6D is an "X-Z" plane cross-section side view illustrating internal features of first and second transitions sections of the sixth multi-band antenna.
Figure 6C:
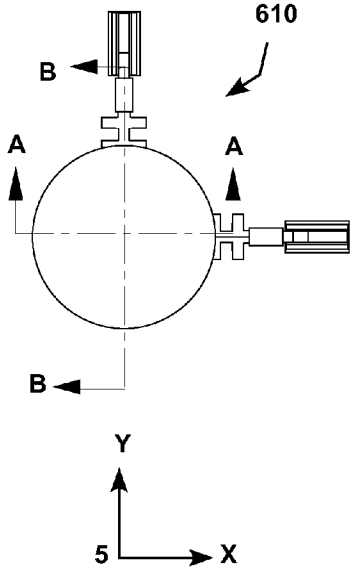
FIG. 6C is a conceptual "X-Y" plane top view of the sixth multi-band antenna illustrating the location of section lines.

FIGS. 6A through 6E illustrate a sixth multi-band antenna 610 for simultaneously communicating low-band signals with linear polarity and high-band signals with circular polarity. FIG. 6A is perspective view of the antenna 610 with the "Z" direction representing the signal propagation direction of the antenna. FIG. 6B is an "X-Z" plane side view of the antenna 610, FIG. 6C is a "Y-Z" plane side view of the antenna 610, and FIG. 6D is an "X-Y" plane top view of the antenna 610. The antenna 610 includes a wave guide horn 612 extending in the signal propagation direction from a reception end 614 shown at the top of FIG. 5A to high-band port 616 shown at the bottom of FIG. 5A. The wave guide horn 612 includes a first transition section 618 with an upper reception section 619 having a circular cross-section transverse to the signal propagation direction that decreases in radial extent until it merges into a smaller circular profile. A wave guide section 621 with a substantially constant radius transverse to the signal propagation section extends from a larger reception cone to the low-band ports 620, 522.

The first transition section 618 extends from the reception end 614 to the low-band ports 620, 622. The first low-band port 620 lies in the "X-Z" plane and leads to a first low-band wave guide 624 for communicating a first linear polarity (e.g., horizontal or "H" polarity) of the low-band signal. The second low-band port 622 lies in the "Y-Z" plane and leads to a second low-band wave guide 626 for communicating a second linear polarity (e.g., vertical or "V" polarity) of the low-band signal. The first low-band wave guide 624 includes a high-band rejection filter 634 to prevent the high-band signal from propagating through the low-band wave guide 624, and the second low-band wave guide 626 includes a high-band rejection filter 636 to prevent the high-band signal from propagating through the low-band wave guide 626. As the first transition section 618 is located between the reception end 614 and the low-band ports 620, 622 (i.e., above the low-band ports), both the high-band and low-band signals propagate through the first transition section 618.

The horn 612 further includes a second transition section 630 that extends from below the low-band ports 620, 622 to the high-band port 616. As the second transition section 630 is located between the low-band ports 620, 622 and the high-band port 616, (i.e., below the low-band ports), only the high-band signal propagate through the second transition section 630. In this particular embodiment, the upper wave guide section 621 includes a first set of ridges 640 (only one ridge is illustrated in FIG. 5A for clarity, while both ridges are illustrated in FIG. 5F), and the lower transition section 630 includes a second pair of ridges 632 (only one ridge is illustrated in FIG. 5A for clarity, while both ridges are illustrated in FIG. 5E) that in combination impart 90 degrees of differentially phase shift to the linear components of the circular polarity high-band signal to polarize the high-band signal as it propagates through the antenna 610. It should be noted here that a specific structure for the high-band port 616 is not illustrated and is typically implemented in a structure immediately following the high-band port 616, such as a high-band wave guide, low-noise amplifier, or other suitable structure. Any type of suitable high-band pickups may be used, such as probes, wave guide openings, a wave guide divided by a septum, and so forth.

FIG. 6B is a conceptual "X-Y" plane top view of the antenna 610 illustrating the locations and orientations of the high-band and low-band ports. The first low-band output port 620 is aligned in the "X" direction and the second low-band output port 622 is aligned in the "Y" direction. The decreasing circular shape of the reception section 619 does not affect the polarity of the linear polarity low-band signal. The high-band output ports 640, 642, on the other hand, are aligned at 45 degrees to the "Y" and "X" axes, respectively. As a result, any ridges in the internal profile of the antenna that are aligned with the "X' axis or the "Y" axis do not affect the polarity of the linearly polarity low-band signal, while they differentially phase shift the linear components of the circular polarity high-band signal as the signal propagates through the antenna. The length, shape and taper of the ridges are therefore specifically designed to impart 90 degrees of differential phase shift to the linear components of the circular polarity high-band signal to polarize the high-band signal as it propagates through the antenna 610.

In this particular embodiment, the first set of ridges 640 on the interior surface of the upper wave guide section 621 impart 30 degrees of differential phase shift to the linear components of the circular polarity high0band signal, while the second set of ridges 632 on the interior surface of the lower transition section 630 impart 30 degrees of differential phase shift to the linear components of the circular polarity high-band signal in the same direction (i.e., additive 30 degrees) for a total of 90 degrees, which polarizes the circular polarity high-band signal into linear polarities at the high-band port 616.

Figure 7B:
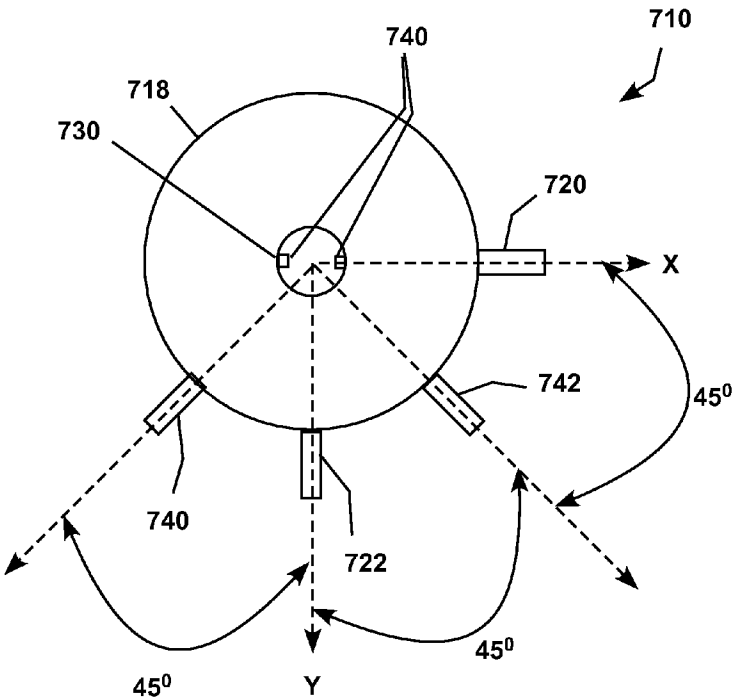
FIG. 7B is a conceptual "X-Y" plane top view of the seventh multi-band antenna illustrating the locations and orientations of the high-band and low-band ports.
Figure 7A:
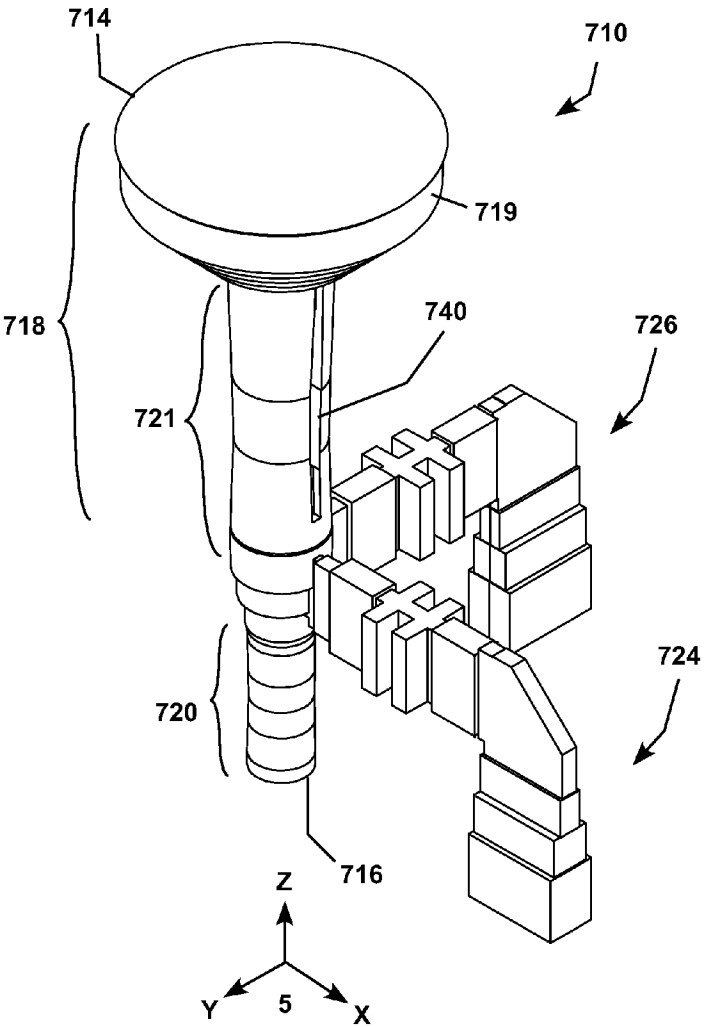
FIG. 7A is perspective view of a seventh multi-band antenna with a circular horn designed to simultaneously communicate high high-band signals with circular and linear polarity and low-band signals with linear polarity.
Figure 7E:
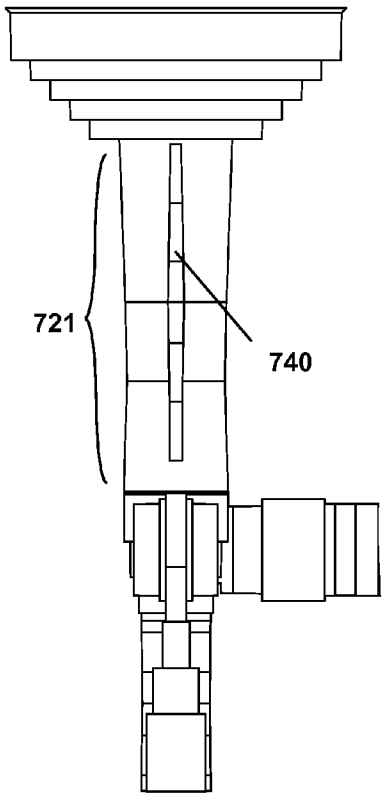
FIG. 7E is a "Y-Z" plane cross-section side view further illustrating the internal features of the transition section of the seventh multi-band antenna.
Figure 7D:
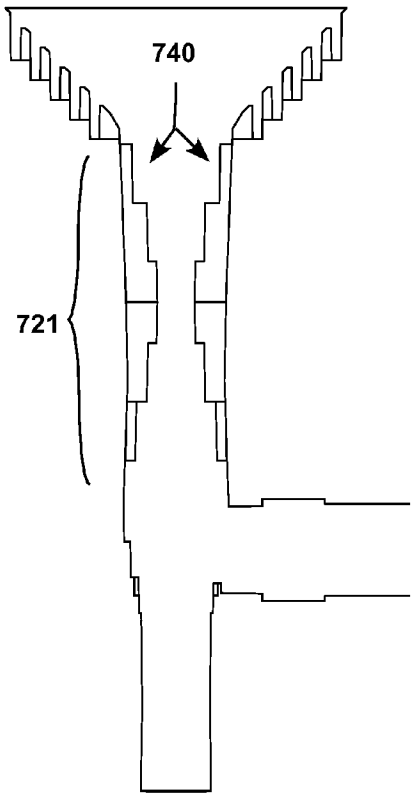
FIG. 7D is an "X-Z" plane cross-section side view illustrating internal features of a transition section of the seventh multi-band antenna.
Figure 7C:
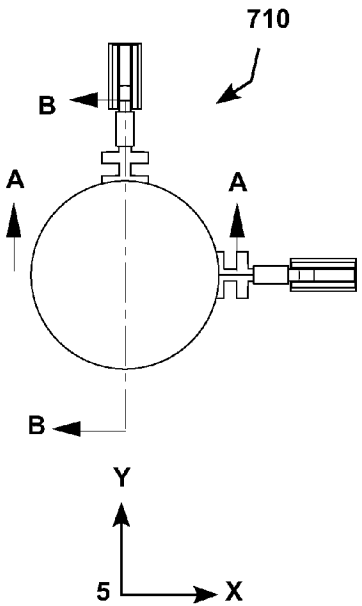
FIG. 7C is a conceptual "X-Y" plane top view of the seventh multi-band antenna illustrating the location of section lines.

FIGS. 7A through 7E illustrate a seventh multi-band antenna 710 for simultaneously communicating low-band signals with linear polarity and high-band signals with circular polarity. FIG. 7A is perspective view of the antenna 710 with the "Z" direction representing the signal propagation direction of the antenna. FIG. 7B is an "X-Z" plane side view of the antenna 710, FIG. 7C is a "Y-Z" plane side view of the antenna 710, and FIG. 7D is an "X-Y" plane top view of the antenna 710. The antenna 710 includes a wave guide horn 712 extending in the signal propagation direction from a reception end 714 shown at the top of FIG. 7A to high-band port 716 shown at the bottom of FIG. 7A. The wave guide horn 712 includes a first transition section 718 with an upper reception section 719 having a circular cross-section transverse to the signal propagation direction that decreases in radial extent until it merges into a smaller circular profile. A wave guide section 721 with a substantially constant radius transverse to the signal propagation section extends from a larger reception cone to the low-band ports 720, 722.

The first transition section 718 extends from the reception end 714 to the low-band ports 720, 722. The first low-band port 720 lies in the "X-Z" plane and leads to a first low-band wave guide 724 for communicating a first linear polarity (e.g., horizontal or "H" polarity) of the low-band signal. The second low-band port 722 lies in the "Y-Z" plane and leads to a second low-band wave guide 726 for communicating a second linear polarity (e.g., vertical or "V" polarity) of the low-band signal. The first low-band wave guide 724 includes a high-band rejection filter 734 to prevent the high-band signal from propagating through the low-band wave guide 724, and the second low-band wave guide 726 includes a high-band rejection filter 736 to prevent the high-band signal from propagating through the low-band wave guide 726. As the first transition section 718 is located between the reception end 714 and the low-band ports 720, 722 (i.e., above the low-band ports), both the high-band and low-band signals propagate through the first transition section 718.

The horn 712 further includes a second transition section 730 that extends from below the low-band ports 720, 722 to the high-band port 716. As the second transition section 730 is located between the low-band ports 720, 722 and the high-band port 716, (i.e., below the low-band ports), only the high-band signal propagate through the second transition section 730. In this particular embodiment, the transition section 721 includes a pair of ridges 740 (only one ridge is illustrated in FIG. 7A for clarity, while both ridges are illustrated in FIG. 7D) that impart 90 degrees of differentially phase shift to the linear components of the circular polarity high-band signal to polarize the high-band signal as it propagates through the antenna 710. It should be noted here that a specific structure for the high-band port 716 is not illustrated and is typically implemented in a structure immediately following the high-band port 716, such as a high-band wave guide, low-noise amplifier, or other suitable structure. Any type of suitable high-band pickups may be used, such as probes, wave guide openings, a wave guide divided by a septum, and so forth.

FIG. 7B is a conceptual "X-Y" plane top view of the antenna 710 illustrating the locations and orientations of the high-band and low-band ports. The first low-band output port 720 is aligned in the "X" direction and the second low-band output port 722 is aligned in the "Y" direction. The decreasing circular shape of the reception section 719 does not affect the polarity of the linear polarity low-band signal. The high-band output ports 740, 742, on the other hand, are aligned at 45 degrees to the "Y" and "X" axes, respectively. As a result, any ridges in the internal profile of the antenna that are aligned with the "X" axis or the "Y" axis do not affect the polarity of the linearly polarity low-band signal, while they differentially phase shift the linear components of the circular polarity high-band signal as the signal propagates through the antenna. The length, shape and taper of the ridges are therefore specifically designed to impart 90 degrees of differential phase shift to the linear components of the circular polarity high-band signal to polarize the high-band signal as it propagates through the antenna 710.

FIG. 7C is a conceptual "X-Y" plane top view of the multi-band antenna 710 illustrating the location of section lines A-A and B-B. FIG. 7D is an "X-Z" plane cross-section side view illustrating internal features of the transition section 721 as viewed along section line A-A and FIG. 7C is a "Y-Z" plane cross-section side view further illustrating the internal features of the transition section 721 as viewed along section line B-B. In this particular embodiment, the ridges 740 lie in the "X-Z" plane and are aligned in the "X" direction. The size, shape and locations of the ridges are specifically designed to impart the desired 90 differential phase shift to the linear components of the circular polarity high-band signal to polarize the high-band signal as it propagates through the upper wave guide section 721.

As a specific example, the high-band signal can in the frequency range of 18.3-20.2 GHz and the low-band signal can be in the in the frequency range of 10.7-12.75 GHz. At these frequencies when designed to illuminate a substantially oblong reflector the approximate dimensions will be as follows:

Total Feed length=75 mm

Ellpitical Horn L=30 mm, W=20 mm, H=35 mm

High Band Circular WG with Ridge section L=28 mm, Diameter=10 mm

Low Band Rectangular Waveguide Port openings=19 mm×9.5 mm, with center displaced 60 mm from center line of feed. The antennas shown in the sets of figures corresponding to a single embodiment (i.e., the set of figures consisting of FIGS. 1A-1H, the set of figures consisting of FIGS. 2A-2H, etc.) are shown generally to scale within the drawing set with the expanded section drawings shown approximately 2:1 with respect to the main illustration. However, the antennas are not shown strictly to scale between drawing sets and the precise dimensions of each embodiment vary in accordance with the specific engineering. The precise dimensions of each embodiment may also vary in practice based on the type and size of reflector used, the type and location of the amplifier used, whether dielectrics are located in the wave guide, and other design considerations. Therefore, the specific dimensions stated above are representative for a typical DVBS embodiment but by no way exclusive.

It should be further understood that in practice, for example in DVBS systems, the high-band signal defines a large number of information carrying frequency channels within the high-band frequency range, and the low-band signal similarly defines a large number of frequency channels within the low-band frequency range. In addition, each polarity provides a separate set of information carrying channels for each frequency channel. Moreover, with digital information encoding, each polarity of each frequency channel can carry multiple distinct digital programming channels. As a result, the multi-band antennas described above actually carry hundreds, and potentially over a thousand, distinct digital programming channels within the high-band and low-band signals simultaneously communicated by the antenna.

In addition, several methods of introducing the needed phase differential between orthogonal linear components can be used in the opposite slop phase differential section described for embodiment 2 including but not limited to using sections of elliptical, rectangular or oblong waveguides, septums, irises, ridges, screws, dielectrics in circular, square, elliptical rectangular, or oblong waveguides. In addition the needed phase differential could be achieved by picking up or splitting off the orthogonal components via probes as in an LNBF or slots as in an OMT (or other means) and then delaying (via simple length or well establish phase shifting methods) one component the appropriate amount relative to the other component in order to achieve the nominal desired total 90° phase differential before recombining.

Elliptically shaped horn apertures are described in the examples in this disclosure, however this invention can be applied to any device that introduces phase differentials between orthogonal linear components that needs to be compensated for in order to achieve good CP conversion and cross polarization (Cross polarization) isolation including but not limited to any non-circular beam feed, rectangular feeds, oblong feeds, contoured corrugated feeds, feed radomes, specific reflector optics, reflector radomes, frequency selective surfaces etc.

The invention claimed is:

1. An antenna extending in a signal propagation direction, comprising:

an input aperture;

a first output port comprising first and second linear polarity pickups spaced apart from the input aperture in the signal propagation direction;

a second output port spaced apart from the first output port in the signal propagation direction;

a wave guide having an internal surface extending in the signal propagation direction from the input aperture to the second output port configured to transmit a propagating electromagnetic signal along the internal surface;

the internal surface of the wave guide defining a first transition section extending from the input aperture to the first output port comprising a phase adjustment structure including at least one ridge extending in the signal propagation direction aligned with the first linear polarity pickup;

the internal surface of the wave guide further defining a second transition section extending from the first output port to the second output port;

wherein the internal surface of the wave guide is configured to simultaneously receive a linear polarity signal and a circular polarity at the input aperture, deliver the linear polarity signal to the first output port, polarize the circular polarity signal into linear components, and deliver the linear components of the circular polarity signal to the second output port.

2. The antenna of claim 1, wherein the first transition section further comprises a pair of opposing ridges extending in the signal propagation direction aligned with the first linear polarity pickup.

3. The antenna of claim 2, wherein the phase adjustment structure of the first transition section differentially phase shifts the linear components of the circular polarity signal by approximately 90 degrees to polarize the circular polarity signal as it propagates through the first transition section.

4. The antenna of claim 2, wherein the second transition section comprises a phase adjustment structure that differentially phase shifts the linear components of the circular polarity signal.

5. The antenna of claim 4, wherein the phase adjustment structure of the second transition section comprises a ridge disposed on an internal surface of the second transition section.

6. The antenna of claim 4, wherein the phase adjustment structure of the second transition section comprises a pair of ridges disposed on opposing sides of an internal surface of the second transition section.

7. The antenna of claim 4, wherein the phase adjustment structure of the second transition section differentially phase shifts the linear components of the circular polarity signal by approximately 90 degrees to polarize the circular polarity signal as it propagates through the second transition section.

8. The antenna of claim 4, wherein:

the first and second transition sections in combination differentially phase shift the linear components of the circular polarity signal by approximately 90 degrees to polarize the circular polarity signal as it propagates through the first and second transition sections.

9. The antenna of claim 8, wherein:

the first phase adjustment structure differentially phase shifts the linear components of the circular polarity signal in a first rotational direction by an amount less than 90 degrees; and the second phase adjustment structure differentially phase shifts the linear components of the circular polarity signal in the first rotational direction by an amount less than 90 degrees.

10. The antenna of claim 8, wherein:

the first phase adjustment structure differentially phase shifts the linear components of the circular polarity signal in a first rotational direction by an amount greater than 90 degrees; and the second phase adjustment structure differentially phase shifts the linear components of the circular polarity signal opposite to the first rotational direction.

11. An antenna extending in a signal propagation direction, comprising:

an input aperture;

a first output port comprising first and second linear polarity pickups spaced apart from the input aperture in the signal propagation direction;

a second output port spaced apart from the first output port in the signal propagation direction;

a wave guide having an internal surface extending in the signal propagation direction from the input aperture to the second output port configured to transmit a propagating electromagnetic signal along the internal surface;

the internal surface of the wave guide defining a first transition section extending from the input aperture to the first output port comprising a phase adjustment structure including an oblong cross section transverse to the signal propagation direction having a major axis aligned with the first linear polarity pickup;

the internal surface of the wave guide further defining a second transition section extending from the first output port to the second output port;

wherein the internal surface of the wave guide is configured to simultaneously receive a linear polarity signal and a circular polarity at the input aperture, deliver the linear polarity signal to the first output port, polarize the circular polarity signal into linear components, and deliver the linear components of the circular polarity signal to the second output port.

12. The antenna of claim 11, wherein the first transition section differentially phase shifts the linear components of the circular polarity signal by approximately 90 degrees to polarize the circular polarity signal as it propagates through the first transition section.

13. The antenna of claim 11, wherein the second transition section comprises a phase adjustment structure that differentially phase shifts the linear components of the circular polarity signal.

14. The antenna of claim 13, wherein the phase adjustment structure of the second transition section comprises a ridge disposed on the internal surface of the waveguide.

15. The antenna of claim 13, wherein the phase adjustment structure of the second transition section comprises a pair of ridges disposed on opposing sides of the internal surface of the wave guide.

16. The antenna of claim 13, wherein the phase adjustment structure of the second transition section differentially phase shifts the linear components of the circular polarity signal by approximately 90 degrees to polarize the circular polarity signal as it propagates through the second transition section.

17. The antenna of claim 13, wherein the first and second transition sections in combination differentially phase shift the linear components of the circular polarity signal by approximately 90 degrees to polarize the circular polarity signal as it propagates through the first and second transition sections.

18. The antenna of claim 17, wherein:

the first phase adjustment structure differentially phase shifts the linear components of the circular polarity signal in a first rotational direction by an amount less than 90 degrees; and the second phase adjustment structure differentially phase shifts the linear components of the circular polarity signal in the first rotational direction by an amount less than 90 degrees.

19. The antenna of claim 17, wherein:

the first phase adjustment structure differentially phase shifts the linear components of the circular polarity signal in a first rotational direction by an amount greater than 90 degrees; and the second phase adjustment structure differentially phase shifts the linear components of the circular polarity signal opposite to the first rotational direction.

* * * * *